US012715728B2

(12) United States Patent
Flynn et al.

(10) Patent No.: US 12,715,728 B2
(45) Date of Patent: Aug. 25, 2026

(54) REEL APPARATUS FOR WINDING, STORING, AND DISPENSING A LENGTH OF A TIE-DOWN STRAP, OR THE LIKE

(71) Applicant: Ligon H. Flynn, Wilmington, NC (US)

(72) Inventors: Ligon Haywood Flynn, Wilmington, NC (US); Brian Campbell, Carolina Beach, NC (US)

(73) Assignee: Ligon H. Flynn, Wilmington, NC (US)

( * ) Notice: Subject to any disclaimer, the term of this patent is extended or adjusted under 35 U.S.C. 154(b) by 128 days.

(21) Appl. No.: 18/729,611

(22) PCT Filed: Jan. 17, 2023

(86) PCT No.: PCT/US2023/010913

§ 371 (c)(1),
(2) Date: Jul. 17, 2024

(87) PCT Pub. No.: WO2023/141086

PCT Pub. Date: Jul. 27, 2023

(65) Prior Publication Data

US 2025/0100845 A1 Mar. 27, 2025

Related U.S. Application Data

(60) Provisional application No. 63/300,429, filed on Jan. 18, 2022.

(51) Int. Cl.
*B65H 75/40* (2006.01)
*B65H 75/44* (2006.01)

(52) U.S. Cl.
CPC ..... *B65H 75/406* (2013.01); *B65H 75/4402* (2013.01); *B65H 75/4492* (2013.01); *B65H 2701/375* (2013.01)

(58) Field of Classification Search
CPC .. B65H 75/28; B65H 75/406; B65H 75/4402; B65H 75/4428; B65H 75/4449; B65H 75/4492
See application file for complete search history.

(56) References Cited

U.S. PATENT DOCUMENTS 3,122,338 A 2/1964 Whittingham
5,623,750 A 4/1997 Nasin et al.
(Continued)

FOREIGN PATENT DOCUMENTS

WO 2021/146498 A1 7/2021
WO 2023141086 A2 7/2023

OTHER PUBLICATIONS

International Search Report and Written Opinion in counterpart International Application No. PCT/US23/10913 dated Jul. 6, 2023, pp. 1-17.

(Continued)

*Primary Examiner* — Sang K Kim
(74) *Attorney, Agent, or Firm* — Additon, Pendleton & Witherspoon, P.A.

(57) ABSTRACT

A reel apparatus configured to wind, store, and dispense a flexible tensile member can include a rotor in a housing. The rotor can include receptacles that can be respectively positioned to receive a portion of a length of the flexible tensile member while the length simultaneously extends through opposite openings in the housing. A crank connected to the rotor can include a handle configured to be releasably locked to the housing in different positions. The flexible tensile member can be a strap of a ratchet strap system.

20 Claims, 21 Drawing Sheets

(56) References Cited

U.S. PATENT DOCUMENTS

| | | | | |
|---|---|---|---|---|
| 5,975,454 | A | 11/1999 | Potter et al. | |
| D435,763 | S | 1/2001 | Potter et al. | |
| 7,766,271 | B1 | 8/2010 | Confoey | |
| 7,942,360 | B2 * | 5/2011 | Breeden | B65H 75/4471 242/378.1 |
| 8,370,997 | B2 | 2/2013 | Wright | |
| 8,910,819 | B2 | 12/2014 | Seiders | |
| 9,567,186 | B2 | 2/2017 | Kucera | |
| D786,657 | S | 5/2017 | Woodrow | |
| 9,676,590 | B1 | 6/2017 | Berry | |
| 10,266,364 | B2 | 4/2019 | Hitsman | |
| 10,723,255 | B2 * | 7/2020 | Plahuta | B60P 7/0846 |
| 10,875,441 | B2 * | 12/2020 | Shrewsbury | B60P 7/0846 |
| 2002/0030133 | A1 | 3/2002 | Ratzlaff | |
| 2013/0206895 | A1 | 8/2013 | Van Benthem et al. | |
| 2015/0352997 | A1 | 12/2015 | Huang | |
| 2018/0370417 | A1 | 12/2018 | Nornes | |
| 2020/0377003 | A1 | 12/2020 | Egigian | |

OTHER PUBLICATIONS

International Preliminary Report on Patentability in counterpart International Application No. PCT/US23/10913 dated Aug. 2, 2024, pp. 1-14.

Roll Profi—Lübbering Abrollsysteme Gmbh & Co. KG, Large cable drum roller, YouTube video at: https://www.bing.com/videos/search?q=drum%20roll%20strap%20winding&view=detail&mid=BBA2F807C482ABB9DB5FBBA2F807C482ABB9DB5F&ajaxhist=0, Mar. 9, 2023, pp. 1.

Mikebald, Ratchet Strap Winder—15ft, at: https://www.thingiverse.com/thing:3502166, Mar. 18, 2019, pp. 1-9.

* cited by examiner

REEL APPARATUS FOR WINDING, STORING, AND DISPENSING A LENGTH OF A TIE-DOWN STRAP, OR THE LIKE

CROSS-REFERENCE TO PRIORITY APPLICATION

This application claims the benefit of U.S. Provisional Patent Application No. 63/300,429, filed Jan. 18, 2022.

BACKGROUND

The present invention generally relates to tie down straps and, more particularly, to an apparatus for collecting and dispensing lengthwise portions of tie down straps.

Tie down straps are widely used to secure items during transport. Loose ends of tie down straps can be a nuisance or dangerous in some situations. For example, the loose end of a tie down strap can become dangerously entangled with one or more moving parts of a vehicle or other machinery. As another example, the loose end of a tie down strap securing an item to a vehicle can be run over by a wheel of the vehicle and become over tensioned, resulting in damage to the tie down strap, secured item, vehicle, and/or a person in the vicinity.

Whereas apparatus for collecting and dispensing lengthwise portions of tie down straps are known, there is a desire for such apparatus that provide a new balance of properties.

SUMMARY

An aspect of this disclosure is the provision of a reel apparatus configured to wind, store, and dispense a flexible tensile member (e.g., a strap of a ratchet strap system), wherein the reel apparatus includes a housing, rotor in the housing, and first and second openings to an interior space of the housing, and wherein the rotor includes a receptacle cooperatively configured with the housing to receive a portion of a length of the flexible tensile member that simultaneously extends through the first and second openings. The rotor can be a single-part component or a multi-part component (e.g., an axle extending through a spindle, wherein the spindle defines the receptacle(s)). The housing can include a base, cover, and at least one sidewall extending at least partially around the interior space of the housing. The at least one sidewall can extend at least partially around the rotational axis of the rotor. The at least one sidewall can define the first and second openings to the interior space. The first and second openings can be spaced apart from one another around the rotational axis of the rotor. An additional length of the flexible tensile member can be pulled into the interior space through the first opening in response to the flexible tensile member being wound onto the rotor. The flexible tensile member can be unwound from the rotor in response to the flexible tensile member being pulled outwardly from the interior space through the first opening. The cover can include first and second cover parts between which a gap is defined. The gap can be a third opening to the interior space. The third opening can be configured to have a length of the flexible tensible member pass inwardly therethrough. The third opening can extend crosswise to, and be laterally offset from, the rotational axis of the rotor. The third opening can extend to, and be open to each of, the first and second openings.

The flexible tensile member can be a first strap of a ratchet strap system that further includes a second strap. The reel apparatus can include a connector connected to the base of the housing, and the connector can be configured to be connected to the second strap of the ratchet strap system.

Another aspect of this disclosure is the provision of a reel apparatus configured to wind, store, and dispense a flexible tensile member, wherein the reel apparatus includes a rotor in a housing, and at least one opening to an interior space of the housing, and wherein the rotor includes first and second receptacles, the first receptacle is aligned with the at least one opening for receiving a portion of a length of a flexible tensile member through the at least one opening while the rotor is in a first rotational position, and the second receptacle is aligned with the at least one opening for receiving a portion of a length of a flexible tensile member through the at least one opening while the rotor is in a second rotational position. The at least one opening can be laterally offset from the rotational axis of the rotor. The at least one opening can include first and second openings that are spaced apart from one another around the rotational axis of the rotor, and a third opening extending between and open to each of the first and second openings.

A further aspect of this disclosure is the provision of a reel apparatus configured to wind, store, and dispense a flexible tensile member, wherein the reel apparatus includes a rotor in a housing, and a crank connected to the rotor for rotating with the rotor relative to the housing, and wherein the housing comprising first and second fastener parts spaced apart from one another around the rotational axis of the rotor, and a third fastener part is connected to the crank for rotating with the crank and being respectively engaged with the first and second fastener parts to releasably secure the rotor in first and second rotational positions.

At least partially reiterating from above, the above-discussed reel apparatuses can be in combination with (e.g., used in a variety of ways with) a ratchet strap system, wherein a portion of a strap of the ratchet strap system is wound upon the rotor, and a portion of the strap extends through a mandrel slot of the ratchet strap system. The strap can be a first strap, and the reel apparatus can include a connector connected to a second strap of the ratchet strap system, so that a portion of the second strap extends through a passageway at least partially defined by the connector.

The foregoing summary provides a few brief examples and is not exhaustive, and the present invention is not limited to the foregoing examples. Various other features, aspects, and advantages of the present invention will be evident from the following description and accompanying drawings.

BRIEF DESCRIPTION OF THE DRAWINGS

The drawings are provided as examples. The present invention may be embodied in many different forms and should not be construed as limited to the examples depicted in the drawings.

DETAILED DESCRIPTION

Examples of embodiments are disclosed in the following. The present invention may, however, be embodied in many different forms and should not be construed as limited to the embodiments set forth herein. For example, features disclosed as part of one embodiment or example can be used in the context of another embodiment or example to yield a further embodiment or example. As another example of the breadth of this disclosure, it is within the scope of this disclosure for one or more of the terms "substantially," "about," "approximately," and/or the like, to qualify each of the adjectives and adverbs of the Detailed Description section of this disclosure.

Figure 1:
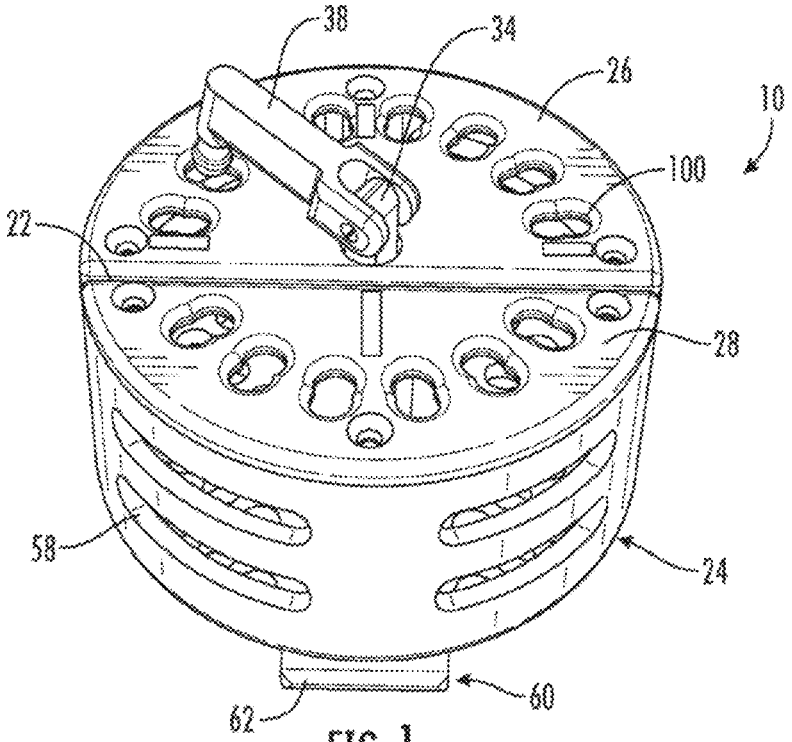
FIG. 1 is top, front pictorial view a reel apparatus in accordance with a first embodiment of this disclosure.
Figure 2:
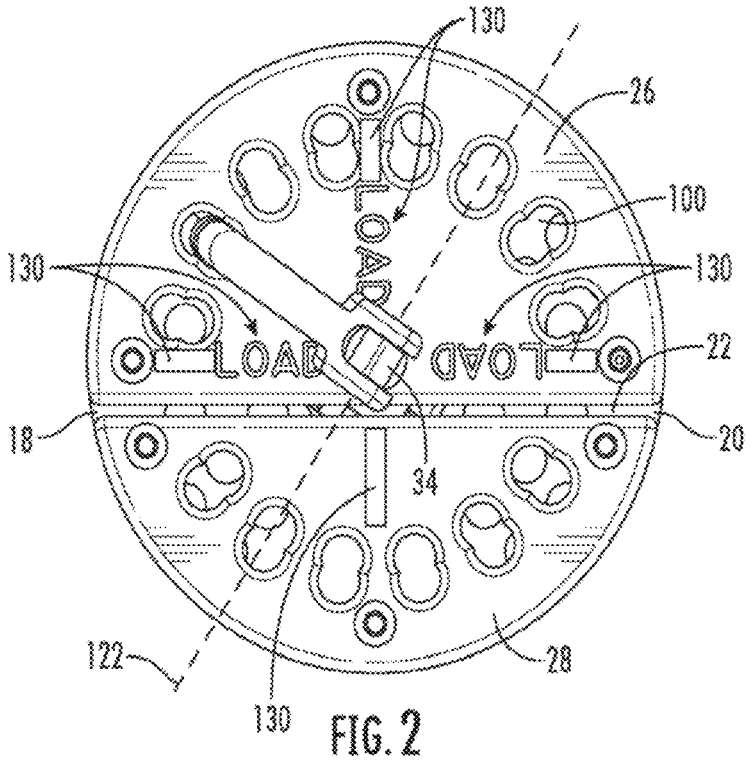
FIG. 2 is a top plan view of the reel apparatus of FIG. 1.
Figure 3:
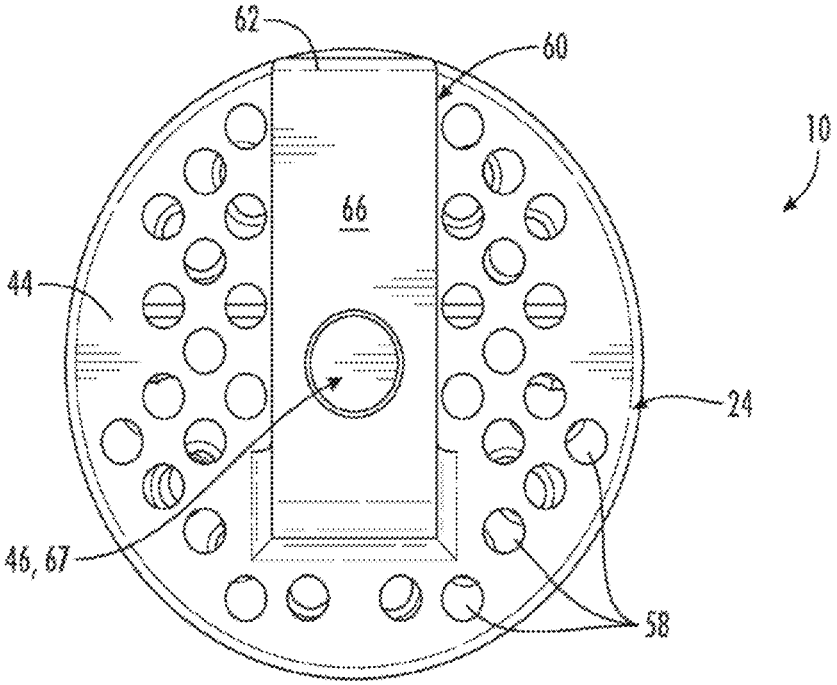
FIG. 3 is a bottom plan view of the reel apparatus of FIG. 1.

FIGS. 1-3 depict an example of a reel apparatus 10 (e.g., winding apparatus) for use in winding in and dispensing (e.g., unwinding) a flexible tensible member, in accordance with a first embodiment of this disclosure. The reel apparatus 10 can be configured for winding and dispensing a variety of different types of flexible tensile members, for example, but not limited to, conventional straps, strings, twines, ropes, wires, fabric strips, and/or other suitable materials. As a more specific example, the first embodiment reel apparatus 10 can be used for winding and dispensing at least a strap, for example the free end of a strap of a tie down strap apparatus, as discussed further below.

Figure 4:
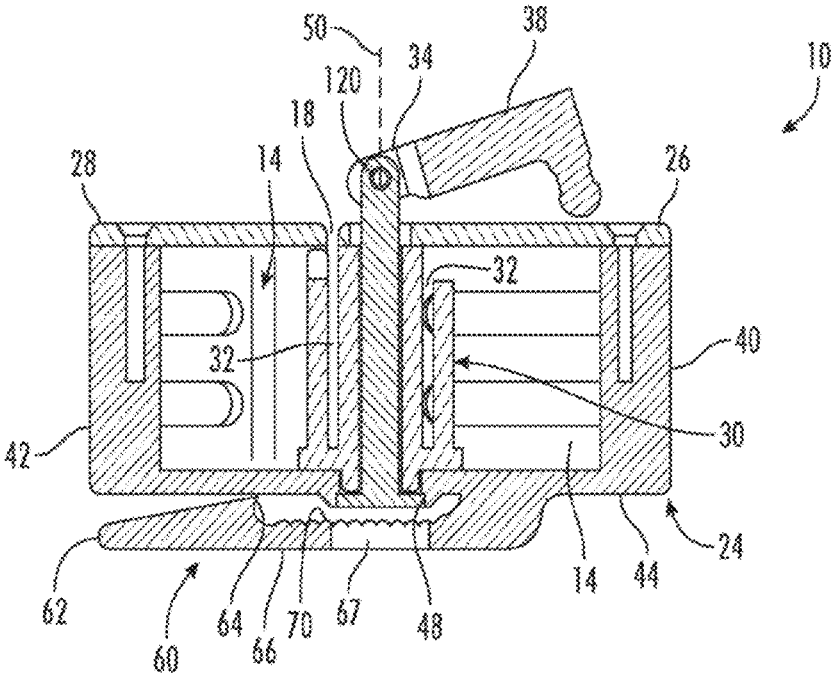
FIG. 4 is a side cross-sectional view of the reel apparatus of FIG. 1, wherein the cross section is taken through the rotational axis of a spindle of the reel apparatus.

Referring to FIG. 4, the first embodiment reel apparatus 10 includes an annular interior space 14 configured to have wound thereinto, and dispensed therefrom, appropriately sized lengths and widths of a flexible tensile member. The reel apparatus 10 is scalable in size and strength. The dimensions and substances used for constructing the reel apparatus 10 may vary to accommodate different types, sizes, and strength requirements for the flexible tensile member to be wound in the interior space 14. For example, the parts of the reel apparatus 10 may be constructed from polymeric material, metallic material, and/or any other suitable materials.

For ease of understanding, a directional frame of reference is generally consistently used in the Brief Description of the Drawings and Detailed Description sections of this disclosure (e.g., by referring to "top," "bottom," "side," "upper," "upwardly," "lower," "base," etc.). The ordinary artisan will understand that the selected directional frame of reference is not limiting because, for example, the reel apparatus 10 can be used in a variety of different orientations. For example, the top of the reel apparatus 10 can alternatively be referred to as a front or other side of the reel apparatus.

In the first embodiment, the reel apparatus 10 includes a housing (see, e.g., container 24 and covers 26, 28) configured to (i) extend at least partially around, and at least partially define, the interior space 14 (FIG. 4), and (ii) define one or more access openings 18, 20, 22 to the interior space. In the first embodiment, the access openings 18, 20, 22 collectively form an access opening configured to allow the flexible tensile member to be passed therethrough into and out of the housing interior space 14.

The housing (see, e.g., container 24 and covers 26, 28) can comprise one or more of each of a frame, container, open-frame container, sidewall, cover, base, and/or any other suitable structure(s). In the example depicted in the drawings, the housing is a generally cylindrical, or the like, and includes a container 24 and one or more covers 26, 28 mounted to the container for partially obstructing an upper opening to the container. That said, differently configured housings (e.g., polygonal, relatively more open, or the like) are within the scope of this disclosure, as discussed further below. As an example, the container 24 can be referred to as a housing and/or the container together with one or more of the covers 26, 28 can be referred to as the housing.

Figure 5:
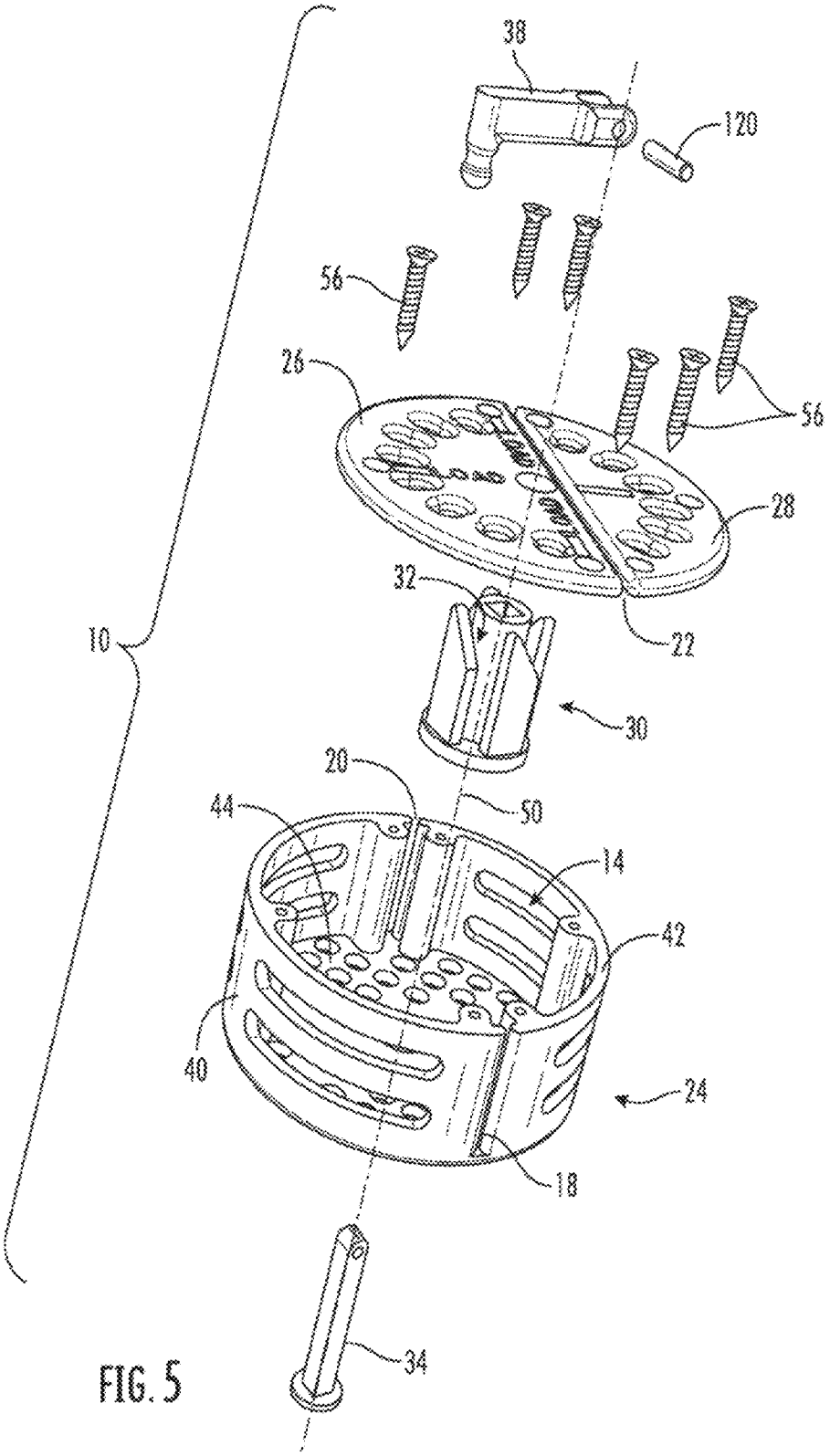
FIG. 5 is an exploded pictorial view of the reel apparatus of FIG. 1.

Referring to FIGS. 4 and 5, the at least one access opening 18, 20, 22 (e.g., loading slot(s)), which can be configured for receiving the flexible tensible member, can be in the form of a compound, multi-legged, or multi-part opening or slot that extends through multiple (e.g., three sides) of the housing 24, 26, 28 for providing access to the housing interior space 14. As a more specific example, the access opening 18, 20, 22 can include, or be in the form of, slots 18, 20, 22 that are respectively open to one another so that a flexible tensile member can be inserted into the housing interior space 14 in a top-loading and/or side-loading fashion through the slots 18, 20, 22.

With continued reference to FIGS. 4 and 5, at least one spindle 30 can be rotatably mounted to the housing 24, 26, 28 and be positioned at least partially in the housing interior space 14. In the first embodiment, the spindle 30 is rotatably mounted by way of at least an axle 34, as discussed further below.

In at least one configuration of the reel apparatus 10, the spindle 30 can be operatively associated with (e.g., adjacent) at least a portion of the one or more access openings 18, 20, 22 so as to be used in winding and unwinding the associated flexible tensile member. The spindle 30 can include at least one opening, which may be referred to as a receptacle 32 (FIG. 4), configured to at least partially receive and at least partially retain (e.g., catch) a portion of the flexible tensile member, and allow the flexible tensile member to be wound onto, and be unwound from, the spindle.

The spindle 30 can be rotatably mounted by way of axle portions of the spindle and/or the spindle can be part of a rotor or rotor apparatus that further includes an axle 34. For providing a broad disclosure, it is noted that such a rotor or rotor apparatus 30, 34 as a whole may be referred to as a spindle.

In the first embodiment, the axle 34 is rotatably mounted to the housing 24, 26, 28, and the spindle 30 is mounted for rotating with the axle. Referring to FIGS. 1, 2, 4, and 5, the rotor 30, 34 can include or be associated with a crank 38 configured to be manually operated to rotate the rotor.

Referring to FIGS. 6-9, the container 24 and/or housing can be upwardly open, and include one or more walls or, more specifically, sidewalls 40, 42 extending upwardly from an outer periphery or outer margin of a lower base panel 44 of the container. At least one upper panel of the container 24 or housing 24, 26, 28 can be formed by the covers 26, 28 and/or other suitable structure(s). The container base panel 44 can be in the form of, or referred to as, at least one wall or panel. The container cover 26, 28 can be in the form of, or referred to as, one or more walls or cover panels 26, 28.

In the first embodiment, the sidewalls 40, 42 extend at least partially around the housing interior space 14. The base panel 44 can be circular and include a central, circular hole configured to function as a lower bearing hole 46. In the first embodiment, the lower bearing hole 46 is coaxial with the central axis 50 of the container and/or housing 24, 26, 28. The lower bearing hole 46 can include, or be partially defined by, an annular shoulder 48 (FIGS. 4 and 9) that generally defines a boundary between upper and lower portions of the lower bearing hole. The upper portion of the lower bearing hole 46 has a relatively small diameter, and the lower hole portion of the lower bearing hole 46 has a relatively large diameter.

As discussed further below, the spindle 30 can be mounted so that its rotational axis is coaxial with the central axis 50; therefore the central axis can be referred to as rotational axis 50 of the spindle 30. In an alternative embodiment, the rotational axis 50 of the spindle 30 can be offset from the central axis of the housing 24, 26, 28 and/or the central axis of the container 24.

The sidewalls 40, 42 can be at least partially spaced apart from one another around the outer margin or periphery of the base 44 so that upright slots 18, 20 of the access opening 18, 20, 22 are respectively defined between adjacent edges of the sidewalls 40, 42. The adjacent edges of the sidewalls 40, 42 that respectively define the upright slots 18, 20 can be rounded (e.g., bullnose edge, beveled edge, or the like). The adjacent edges of the sidewalls 40, 42 that respectively define the upright slots 18, 20 can extend downwardly all the way to the upper surface of the base 44. Alternatively, the upright slots 18, 20 can be defined in a single sidewall extending around the housing interior space 14. For example, such alternative upright slots 18, 20 can be open at the upper edge of the single sidewall without extending to the lower edge of the single sidewall, without extending all the way to the upper surface of the base 44, and/or the like.

The sidewalls 40, 42 can be curved, or more specifically arcuate, so that the sidewalls collectively form a mostly (e.g., substantially) complete cylinder with the exception of, for example, the two upright access slots 18, 20. The sidewalls 40, 42 can comprise a relatively large sidewall 40 and a relative small sidewall 42. In the example depicted in FIGS. 6 and 7, the larger sidewall 40 extends farther around the central axis 50 of the spindle 30, container 24, and/or housing 24, 26, 28 than does the smaller sidewall 42. In the example depicted in the drawings, each of the sidewalls 40, 42 extends partially around the rotational axis 50 of the spindle 30 and the slots 18, 20 are spaced apart from one another around the rotational axis 50 of the spindle 30. One or both of the sidewalls 40, 42 can extend partially around the rotational axis 50 of the spindle 30 through at least 45 degrees, at least 90 degrees, in a range of from about 45 degrees to about 210 degrees, in a range of from about 90 degrees to about 200 degrees, in a range of from about 100 degrees to about 160 degrees, and/or any values or sub-ranges therebetween.

Figure 6:
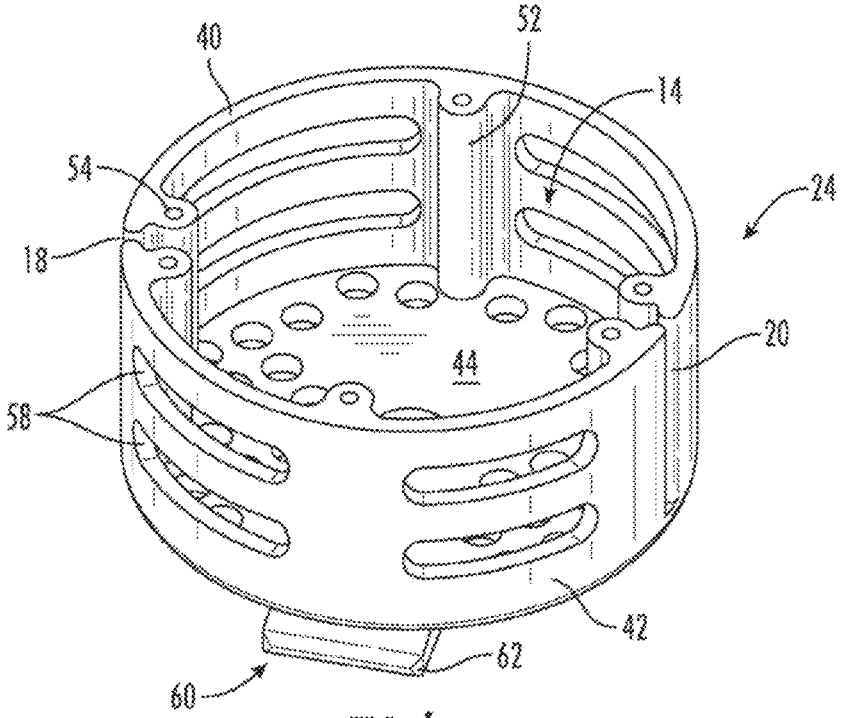
FIG. 6 is an isolated, top pictorial view of a container of the reel apparatus of FIG. 1.
Figure 7:
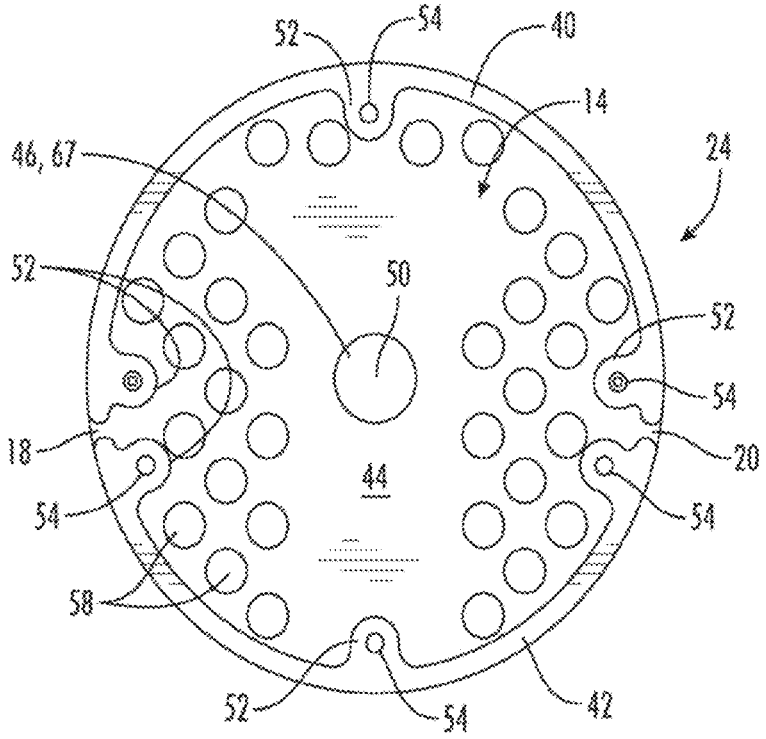
FIG. 7 is a top plan view of the container.

Referring to FIGS. 5-7, the sidewalls 40, 42 can include inwardly protruding ribs 52 extending upwardly from the base 44. Upper ends of the ribs 52 can include mounting holes 54 for respectively receiving fasteners, for example the helically threaded shafts of bolts or screws 56 (FIG. 5) for connecting the covers 26, 28 (FIG. 5) to the upper edges of the sidewalls 40, 42. As another example for connecting the covers 26, 28, they can include downwardly extending protrusions with barbs or other features for engaging in the mounting holes 54 to provide interference fits, snap-fits, and/or other suitable connections between the container 24 and covers. As another example, the covers 26, 28 can be attached to the container 24 with one or more clips, clip-like features, interference fits, or the like, that allow the covers 26, 28 to be snap fit onto and/or into the container 24. As further examples, the ribs 52 can be omitted and/or the covers 26, 28 can be mounted to the container 24 in any other suitable manner (e.g., clips, welding, adhesive material, etc.).

Holes 58 (e.g., vent holes) open to the housing interior space 14 can extend through the base 44 and sidewalls 40, 42 for venting, reducing mass, providing visual access, and/or reducing the amount of material used to form the container 24. Different numbers and shapes of the holes 58 (e.g., vent holes) can be included (e.g., there may be none of the holes 58 and/or at least some of them may not be open to the interior space 14). Numerous other examples are within the scope of this disclosure. For example, in contrast to the example depicted in the drawings wherein the container 24 is a single-piece component, the base 44 can be formed separately from the sidewalls 40, 42 and be mounted to the sidewalls, each sidewall and its respectively associated cover 26, 28 can be formed together as single-piece component, the sidewall(s) together with the covers can be manufactured as a single-piece article, and/or the like.

Figure 8:
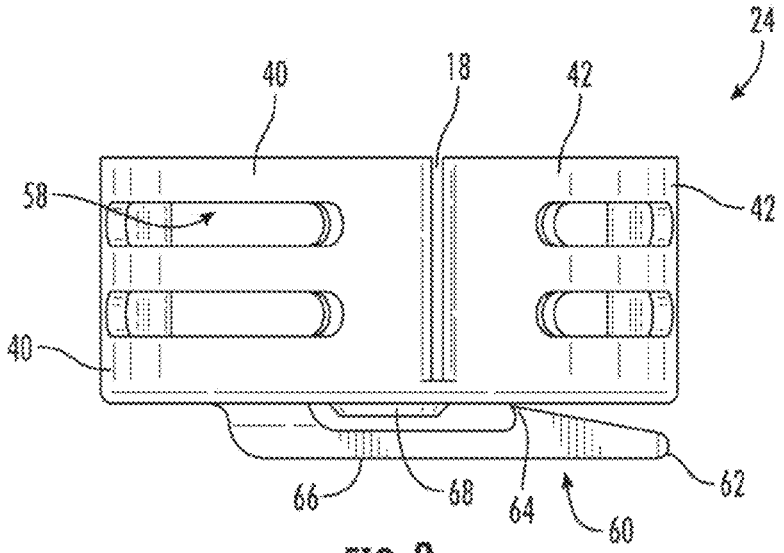
FIG. 8 is a left side elevation view of the container (based upon the orientation of FIG. 7), wherein a right elevation view of the container is a mirror image of FIG. 8.
Figure 9:
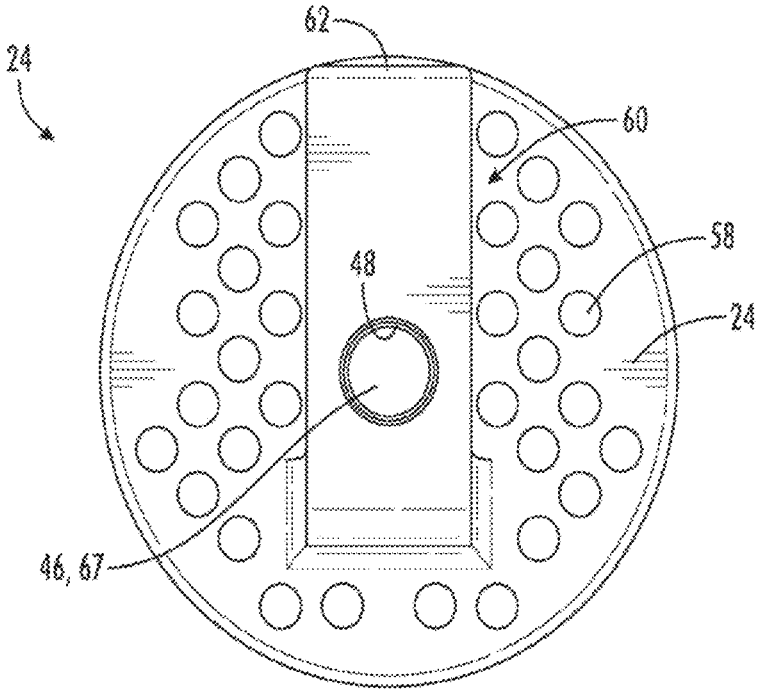
FIG. 9 is a bottom plan view of the container.
Figure 10:
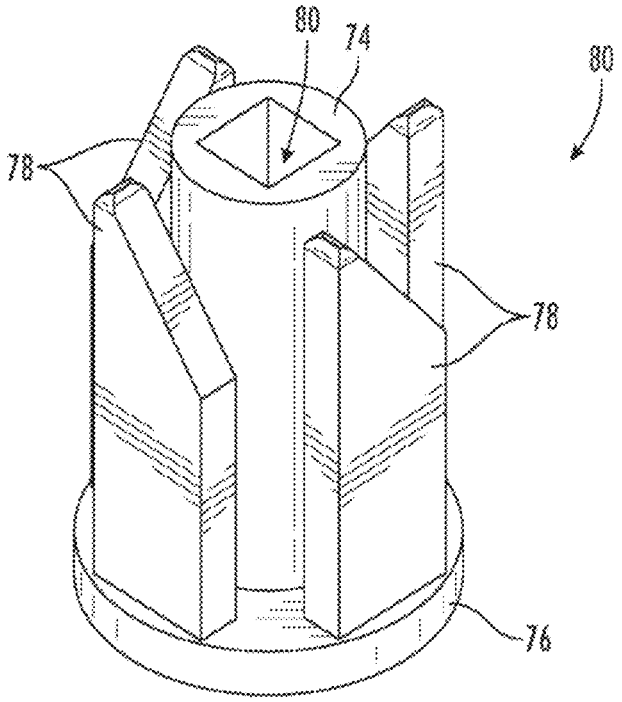
FIG. 10 is an isolated, top, side pictorial view of the spindle of the reel apparatus of FIG. 1.

Referring to FIGS. 8 and 9, the housing 24, 26, 28, or more specifically the container 24, can include, or have mounted to, one or more connectors 60 such as, but not limited to, a clip connector 60. The clip connector 60 can be configured to connect the reel apparatus 10 to at least one flexible tensile member and/or any other suitable structure. For the first embodiment, the clip connector 60 can be described as, can include, and/or be in the form of a clip arm 60 having (i) a proximal fixed end portion connected and extending outwardly from the outer surface of the container base 44, and (ii) an opposite distal free end portion 62 that is elastically biased toward a closed configuration. The clip free end 62 can be referred to as (e.g., used as) a clip handle for manually opening the clip arm 60. The clip connector 60 (e.g., clip arm) can include at least one protruding, engaging part 64 (e.g., edge, rib, tooth, or barb) that extends crosswise to the clip arm and securely engages the outer surface of the container base 44 when the clip arm is in its closed configuration. An intermediate section 66 of the clip arm 60 can extend from the fixed end of the clip arm to the clip's engaging part 64. In the example depicted in FIG. 9, a hole 67 extends through the intermediate section 66. This hole 67 can be superposed with, aligned with, and or coaxial with the rotational axis 50 of the spindle 30 and the lower bearing hole 46 in the container base 44.

A gap in the form of a passageway 68 (FIG. 8) can be defined between the intermediate portion 66 and the container base 44 when the clip arm or connector 60 is in its closed configuration. The passageway 68 may be used to receive and hold a portion of a flexible tensile member and/or the clip connector 60 can be configured to connect to any other suitable structure(s). The clip's intermediate portion 66 can include a contoured surface 70 defining an undulating shape (e.g., teeth) facing, and spaced apart from, the base 44 when the clip connector 60 is in its closed configuration. Alternatively, the one or more peaks of the contoured surface 68 may engage the container base 44 when the clip connector 60 is in its closed configuration. In the first embodiment, the clip connector 60 (e.g., clip arm) extends crosswise to (e.g., perpendicular to) the transverse slot portion 22 (FIGS. 1 and 2) of the access opening 18, 20, 22 (FIG. 5).

The biased nature of the clip connector or arm 60 can be provided by elasticity of the material from which the clip connector is constructed and/or the clip connector can include or otherwise be operatively associated with spring(s) that provide the biasing force(s). The clip connector 60 can be formed as a single-piece component with the container 24, or it can be formed separately from, and be mounted to, the container by one or more suitable fasteners or fastening mechanisms. For example, the clip connector 60 can be or include a piece of spring metal having a bent inner end portion that is connected to the container base 44. Alternatively, any other suitable clip connector 60 or other suitable connector may be included as part of, or used in association with, the housing 24, 26, 28.

At least partially reiterating from above, the clip connector or clip arm 60 is one type of connector that the housing 24, 26, 28 may include or with which the housing may be associated. Any such connector (e.g., for replacing and/or supplementing the clip connector 60) may alternatively be in the form of one or more of a fastener, clamp, mounting bracket (e.g., U-shaped bracket), latch, and/or any other suitable connector. As one example of a variation, the flexible or pivotable arm of the clip connector 60 can be a latch having a distal end configured to releasably engage with a keeper (not depicted in the drawings) mounted to the housing 24, 26, 28. As a similar example, the clip connector 60 can be replaced with a connector in the form of latching mechanism including a latch and a keeper. The arm of the clip connector 60 can be modified to be the latch of the latching mechanism. The keeper can be mounted to the base panel 44 or other suitable portion of the container 24. The latch can include a medial portion between opposite proximate and distal ends of the latch. The proximal end of the latch can be pivotably mounted to the base panel 44 or other suitable portion of the container 24. The latch and keeper can be cooperatively configured (e.g., the latch can be made of a flexible elastic material, and the keeper and latch distal end can be cooperatively configured for releasably engaging with one another) to provide open and closed configurations of the latching mechanism. In the closed configuration of the latching mechanism, the passageway for the flexible tensile member (see, e.g., FIG. 8, passageway 68) can be defined between the latch medial portion and the container base 44.

Referring to FIGS. 10-13, the spindle 30 can include an inner part or shaft that can be in the form of a tube 74. The spindle 30 can include a base plate, head, or the like, in the form of an annular flange 76 extending outwardly from a lower portion of the tube 74. An outwardly cylindrical upper portion of the tube 74 can extend upwardly from the flange 76, and an outwardly cylindrical lower portion of the tube 74 can extend downwardly from the flange 76. The lower portion of the tube 74 can have a smaller outer diameter than the outwardly cylindrical upper portion of the tube 74. Alternatively, the upper and lower portions of the tube 74 can have the same diameter and/or define other suitable shapes, the lower portion of the tube 74 may be omitted, and/or the spindle 30 can be in any other suitable configuration.

Reiterating from above, the spindle 30 typically includes at least one receptacle 32 or other suitable feature configured to at least partially hold a portion of a flexible tensile member being passed through the transverse access slot 22 (FIGS. 1, 2, 4, and 5) into the housing interior space 14 (FIGS. 4 and 5). For example, the one or more spindle receptacles 32 can be openings or slots cut into a precursor of the spindle 30 or otherwise suitably defined by the spindle. In the first embodiment, a series of projections or prongs 78 can extending upwardly from the upper side of the flange 76 for at least partially defining a series of the spindle receptacles 32.

Figure 11:
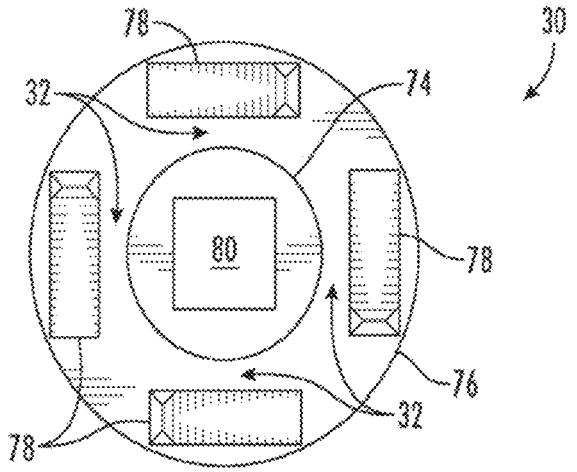
FIG. 11 is a top plan view of the spindle.

As best understood with reference to the example depicted in FIG. 11, the series of prongs 78 extends partially around the tube 74 and the prongs are space apart from the tube to respectively form the series of spindle receptacles 32. More generally, the one or more prongs 78 can extend along, and be spaced apart from, both one another and the outer surface of the tube 74. Gaps for receiving a portion of the flexible tensile member are defined between adjacent prongs 78, and between the prongs and the tube 74 (see, e.g., spindle receptacles 32).

Each prong 78 can include a tapered upper end. The tapered upper ends of the prongs 78 can be configured to slidingly engage a portion of a flexible tensile member being passed through the transverse access slot 22 (FIGS. 1, 2, 4, and 5) into the housing interior space 14 (FIGS. 4 and 5). The tapered prong ends can be configured to guide the subject portion of the flexible tensile member into an adjacent spindle receptacle 32 and/or cause the spindle 30 to rotate, if necessary, so that the subject portion of the flexible tensile member can move into the respective spindle receptacle 32. Each prong 78 and associated spindle receptacle 32 can be configured to receive the subject portion of the flexible tensile member in a manner that allows the flexible tensile member to thereafter be wound onto the spindle 30. The receptacles 32 rotate with the rotor 30, 34 and are spaced apart from one another around the rotational axis 50 of the rotor.

In the first embodiment, the spindle shaft or tube 47 includes an interior passageway 80 extending therethrough, from the upper end of the tube to the lower end of the tube. As best understood by also referring to the example depicted in FIG. 4, the spindle passageway 80 is configured to have a portion of the axle 34 extend therethrough. In the first embodiment, as best understood with reference to FIGS. 4 and 12, the spindle 30 is positioned in the housing interior space 14 so that the lower portion of the tube 74 is positioned in the upper portion of the lower bearing hole 46 (FIG. 7). This cooperative configuration can be part of the spindle 30 being mounted for rotating coaxially with the central axis 50 of the container 24 and/or housing 24, 26, 28. Accordingly, reference number 50 can also designate the rotational axis of the spindle 50.

Figure 14:
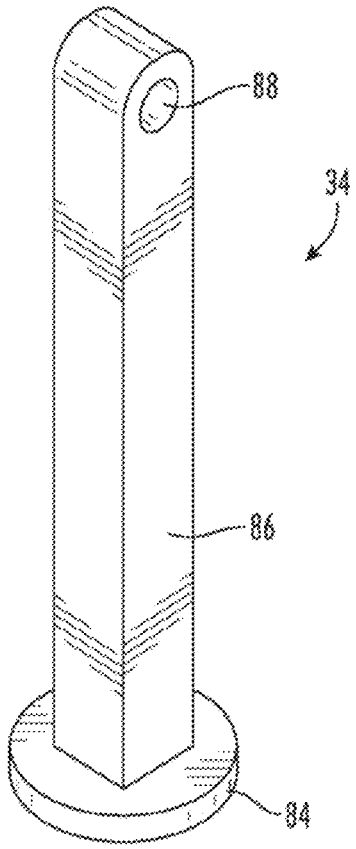
FIG. 14 is an isolated, top, side pictorial view an axle of the reel apparatus of FIG. 1.
Figure 15:
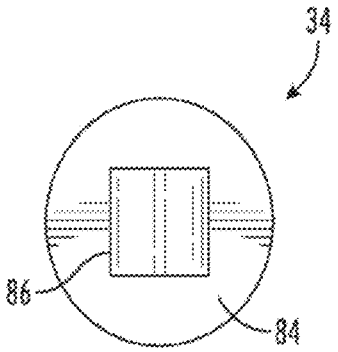
FIG. 15 is a top plan view of the axle.

Referring to FIGS. 14-15, the axle 34 can include an annular base, head, or flange 84 extending outwardly from a lower end portion of a shaft 86 of the axle. The lengthwise outer surface of the axle shaft 86 and the lengthwise inner surface of the spindle tube 74 can be cooperatively configured to sliding mate with one another in a lengthwise direction, and engage with one another in a crosswise direction so that the mated together spindle tube 74 and axle shaft 86 rotate coaxially together. For being rotationally and coaxially fixed to one another, the outer surface of the axle shaft 86 and the inner surface of the spindle tube 74 can be cooperatively configured for being mated together, for example by both being rectangular or in any other suitable configuration. A hole 88 can extend through the upper end portion of the axle shaft 86. Numerous other examples are within the scope of this disclosure. For example and at least partially reiterating from above, the spindle 30 and axle 34 can be formed together as a single piece component, so that opposite ends of the spindle are in the form of axle portions, or the like.

Figure 12:
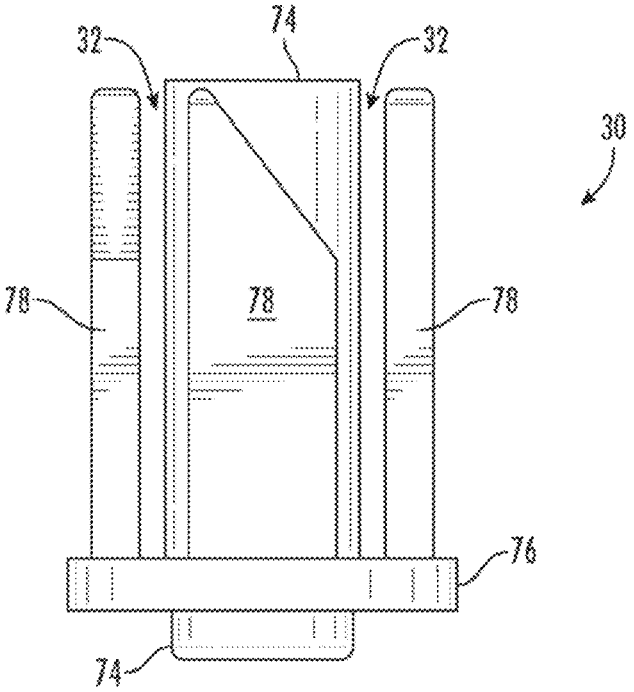
FIG. 12 is representative of each of front, right, left, and rear elevation views of the spindle (based upon the orientation of FIG. 11).
Figure 13:
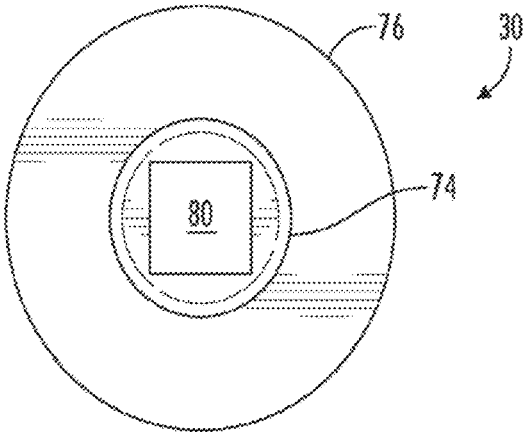
FIG. 13 is a bottom plan view of the spindle (based upon the orientation of FIG. 11).

In the first embodiment, as best understood with reference to FIGS. 4 and 12, the axle 34 can be passed through the clip hole 67 so that the axle shaft 84 extends through the tube passageway 80 and the axle flange 84 is positioned in the lower portion of the lower bearing hole 46 (FIG. 7). A portion of the axle flange 84 (e.g., an annular, outer, marginal portion of the upper surface of the axle flange 84) can be slidingly engaged against the shoulder 48 (FIGS. 4 and 9). This cooperative configuration can be part of the axle 30 being mounted for rotating coaxially with the central axis 50 of the container 24 and/or housing 24, 26, 28.

Figure 16:
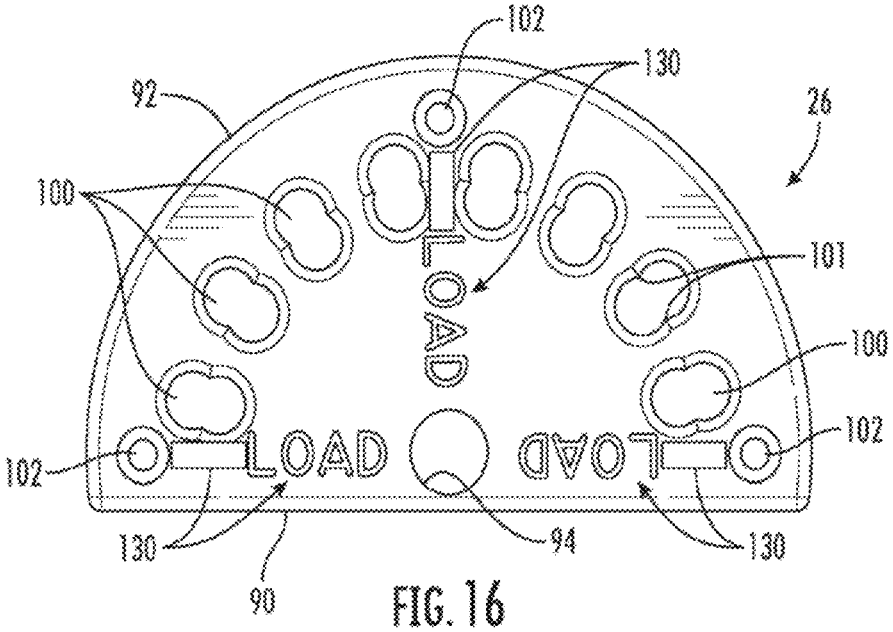
FIG. 16 is an isolated top plan view of a cover of the of the reel apparatus of FIG. 1.
Figure 17:
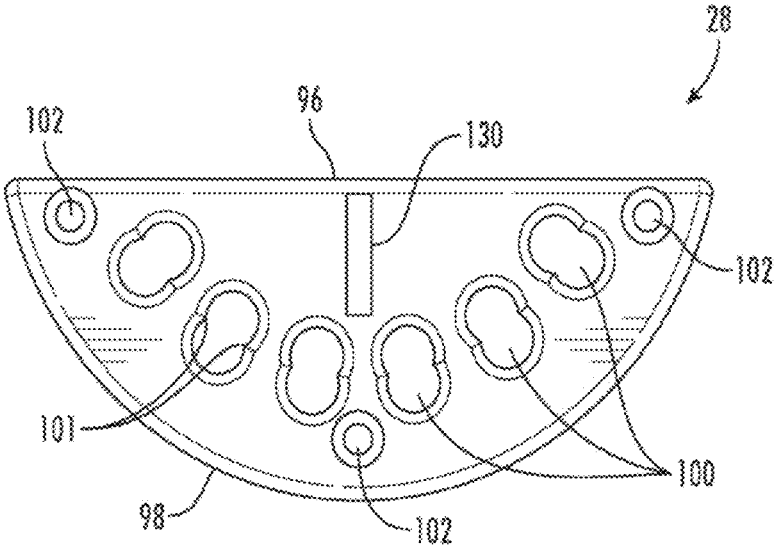
FIG. 17 is an isolated top plan view of another cover of the of the reel apparatus of FIG. 1.

Referring to FIGS. 16-17, the cover panels 26, 28 (e.g., their peripheries) can be shaped like circular segments. In accordance with the first embodiment, and as best understood with reference to FIG. 16, the relatively large cover panel 26 includes a relatively straight outer edge 90 (e.g., straight edge) extending between opposite ends of a relatively curved or arcuate outer edge 92 (e.g., circular arc), and an upper bearing hole 94 extends through the large cover panel. Similarly and referring to FIG. 17, the relatively small cover panel 28 can include a relatively straight outer edge 96 (e.g., straight edge) extending between opposite ends of a relatively curved or arcuate outer edge 98 (e.g., circular arc). In the context of the cover panels 26, 28 being in the shape of partial circles, the relative straight edges 90, 96 may also be referred to as secant edges, chord edges, truncating edges, or the like. In the direction between the opposite faces or major sides of the cover panels 26, 28, the edges 90, 92, 96, 98 can be rounded (e.g., bullnose edge, beveled edge, or the like).

Referring to FIGS. 16-17, holes 100 can extend through each of the covers 26, 28, and be arranged in series that extend proximate and along the arcuate edges 92, 98. Each of holes 100 can be configured to function as a connector part, for example a connector hole 100 configured to function as part of a snap-fit feature, or the like. Each of the connector holes 100 can be in the shape of a modified oval (e.g., comprising opposite sides of the oval forming inwardly protruding edges, protrusions, tips, and/or the like), an inverted ellipse, a multi-lobed hole, a two lobed hole with a midsection having a crosswise dimension smaller than the diameter of the lobed sections, and/or any other suitable shape. The covers' inner edges that define the holes 100 can define inwardly protruding, flexible catches 101. Each hole 100 can include one or more catches 101 that can be opposite from one another and that generally point toward one another, as discussed further below.

The covers 26, 28 can also include mounting holes 102 (e.g., countersunk) for respectively receiving the heads of fasteners, for example bolts or screws 56 (FIG. 5) for connecting the covers 26, 28 to the upper edges of the sidewalls 40, 42. At least partially reiterating from above, alternatively or additionally, the covers 26, 28 can include downwardly extending protrusions with barbs or other features for engaging in the mounting holes 54 to provide interference fits, snap-fits, and/or the covers can be mounted in any other suitable manner. Different numbers and shapes of the holes 100, 102 can be included (e.g., none of these holes may be included).

In the first embodiment, as best understood with reference to FIGS. 1, 2, 16, and 17, the covers 26, 28 are mounted to the container 24 so that the upper bearing hole 94 is coaxial with the axis 50 (e.g., the rotational axis of spindle 30, which may also be the central axis of the container and/or housing 24, 26, 28), the upper end portion of the axle 34 extends through the upper bearing hole 94, the transverse slot 22 is defined between the straight edges 90, 96, and the transverse slot 22 and straight edges 90, 96 are laterally offset from the rotational axis 50 of the spindle 30. The adjacent relatively straight edges 90, 96 that define the transverse slot 22 can be rounded (e.g., bullnose edge, beveled edge, or the like).

Figure 18:
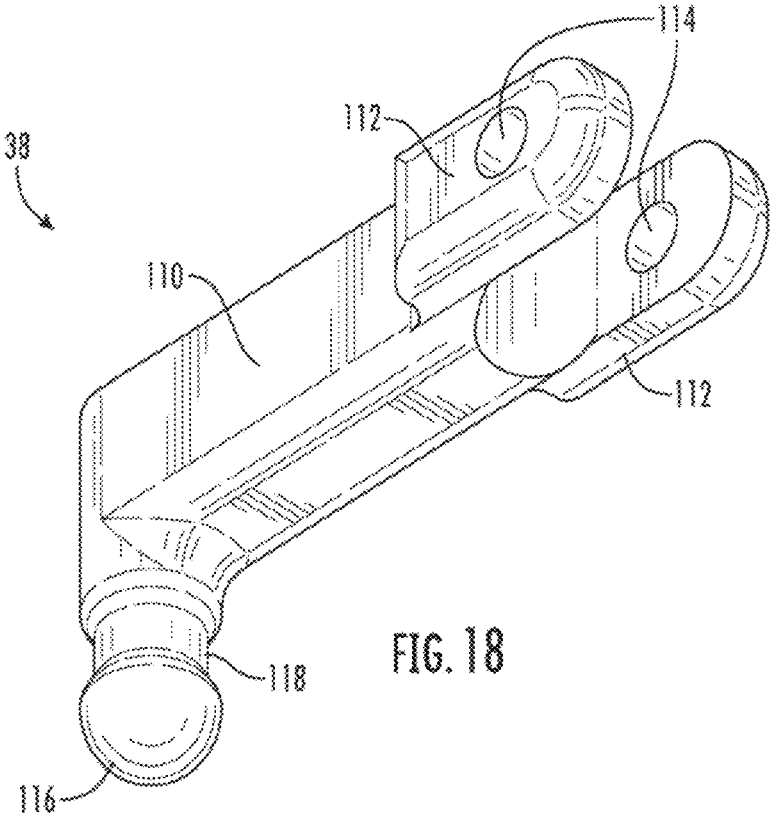
FIG. 18 is an isolated pictorial view of a crank of the reel apparatus of FIG. 1.
Figure 19:
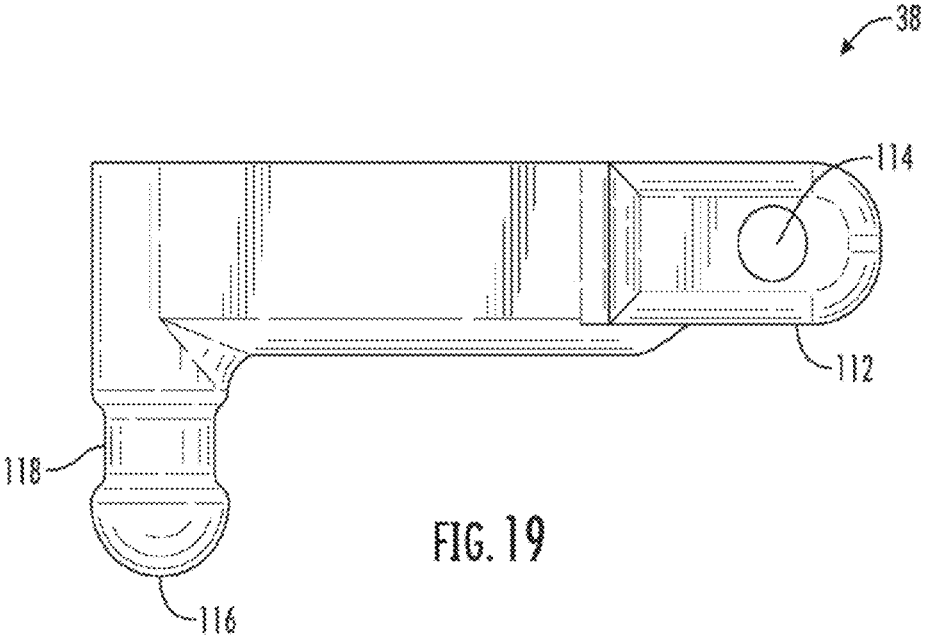
FIG. 19 can be referred to as a right elevation view of the crank, wherein a left elevation view of the crank is a mirror image of FIG. 19.

Referring to FIGS. 18-19, the crank 38 can include a shaft 110 and at least one proximal extension, bracket, protrusion, or fork having of pair of prongs 112 extending from an inner end portion of the shaft. The prongs 112 can extend in the same direction as (e.g., parallel to), and be extensions of, the shaft 110. Holes 114 can extend through the prongs 112. The crank 38 can also include a distal protrusion, extension, lobe, or knob 116 extending from an outer end portion of the shaft 110. At least the protruding knob 116 and/or other suitable structure can extend crosswise to (e.g., perpendicular to) the shaft 110 and function as a handle and/or connecting (e.g., interlocking and/or snap-fit) feature, as discussed further below. As part of the knob 116, or between the knob and the shaft 110, an at least partially recessed part of the crank 38, or the like, can be in the form of an annular neck 118 having a diameter less than the largest diameter of the knob 116. The distal portion of the crank 38 (e.g., knob 116 and/or neck 118) can be used as a handle for being manually manipulated to rotate the crank, as discussed further below.

Referring to FIGS. 4 and 5, the inner end portion of the crank 38 can be pivotably connected to the upper end portion of the spindle 30, rotor, or axle 34 in any suitable manner. For example, this pivotable connection can be provided by a pivot pin 120 connected to the upper portion of the axle 34 and the inner portion of the crank 38 and/or in any other suitable manner. More specifically and as best understood with reference to FIGS. 4, 5, 14, and 18, the crank 38 can be pivotably mounted to the upper end portion of the axle 34 by way of the pivot pin 120 extending through the hole 88 in the axle 34 and the pivot pin extending at least partially into the holes 114 of the crank 38. Respective portions of the crank 38 can engage at least a portion of the cover 26, 28 of the housing 24, 26, 28 in a cooperative manner that restricts the crank (e.g., an inner portion of the crank) from passing through the relatively large cover's upper bearing hole 94.

The pivotable connection between the axle 34 and crank 38 can be configured so that the crank 38 can be manually pivoted 180 degrees, or about 180 degrees, relative to the upper end of the axle 34 about a crank pivot axis 122 (FIG. 2) that intersects and extends crosswise to (e.g., perpendicular to) the rotational axis 50 of the axle and spindle 30. The crank 38 can be pivoted relative to the axle 34 between open and closed configurations.

In an example of the open configuration of the first embodiment reel apparatus 10, the side of the crank 38 opposite from the knob 116 is in opposing face-to-face relation with the outer surface of the cover 26, 28. In the open (or winding) configuration or position, the crank 38 can function as a winding lever that is manually rotated circularly (e.g., by way of manually rotating the outer knob 116 (e.g., handle)) to turn the spindle 30 and wind an associated flexible tensile member into the housing interior space 14 and onto the spindle.

In an example of the closed configuration, the side of the crank 38 from which the knob 116 extends is in opposing face-to-face relation with the outer surface of the cover 26, 28. The crank 38 can be releasably locked in the closed configuration in any suitable manner. For example, the crank 38 can be locked in the closed configuration by engaging the outer knob 116 against a predetermined portion of the reel apparatus 10, for example a predetermined portion of the housing 24, 26, 28, for example a predetermined portion of (e.g., a respective edge of) the cover 26, 28. As a more specific example, the crank 38 can be pivoted so that the outer knob 116 is inserted into a respective one of the cover's connector holes 100 to provide the locked configuration, wherein corresponding portions of the edge(s) of the respective connector hole and the outer knob interact to provide an interlocking fastener that can be manually fastened and unfastened. For example, tips or free ends of respective catches 101 of the covers 26, 28 or holes 100 can be elastic and extend into a recessed area defined, for example, by the neck 118 and/or be engage against the neck 118 to provide a selectively releasable engagement or interference fit, or the like, to releasably secure or lock the crank 38 in its closed configuration. The knob 116, neck 118, holes 100, and catches 101 can be individually referred to as fastener parts and collectively referred to as fastening mechanisms for securing the crank 38 in its locked closed configuration, and those fastener parts and fastening mechanisms can be modified and/or replaced with other suitable fastening features.

In the first embodiment, when the crank 38 is locked closed (e.g., the outer knob 116 is inserted into or through a connector hole 100 to provide a selectively releasable interference fit), the spindle 30 is restricted or prevented from rotating, so that a length of a flexible tensile member wound onto the spindle remains securely positioned in the housing interior space 14 of the housing 24, 26, 28. The fastened or locked configuration restricts or prevents a portion of a flexible tensile member that is wound upon the spindle 30 from unwinding. In the first embodiment there are fourteen fastener parts in the form of connector holes 100 into which the knob 116 (e.g., another fastener part) can be respectively received, so that there are fourteen fastened or locked configurations, although different numbers of such features are within the scope of this disclosure. For example, first and second of the connector holes 100 can be referred to as first and second fastener parts configured to be respectively mated with the knob 116 and/or neck 118 (e.g., third fastener part and/or handle) to provide first and second fastened configurations.

Referring to FIGS. 2 and 4, the outer surface of the cover 26, 28 and/or other portions of the reel apparatus 10 can include indicators 130 (e.g., indicium, indicia, number(s), letter(s), graphic(s), symbol(s) and/or other suitably distinctive marking(s)) with which the crank 38 can be respectively aligned to respectively align the spindle receptacles 32 with the access opening 18, 20, 22 (e.g., transvers slot 22). As an example of a method of using the reel apparatus 10, such alignment seeks to help facilitate insertion of a respective portion of the flexible tensile member through the access opening 18, 20, 22 so that the portion of the flexible tensile member is received in the spindle receptacle 32 aligned with the access opening 18, 20, 22 (e.g., loading slot(s)). As one example, when the length of a section of a flexible tensile member is adjacent and extends along (e.g., is parallel to) the transverse access slot 22 (e.g., and, thus, extends crosswise (e.g., perpendicular to) the rotational axis 50 of the spindle 30), that lengthwise section can be passed through the transverse slot so that the flexible tensile member extends through each of the upright access slots 18, 20 and a respective spindle receptacle 32. While that lengthwise section is positioned in the housing interior space 14, upright access slots 18, 20, and the respective spindle receptacle 32, the flexible tensile member can be wound upon the spindle 30 by rotating the unlocked crank 38.

In accordance with the first embodiment, a first of the receptacles 32 is aligned with the access opening 18, 20, 22 while the rotor 30, 34 is in a first rotational position, a second of the receptacles is aligned with the access opening while the rotor is in a second rotational position, a third of the receptacles is aligned with the access opening while the rotor is in a third rotational position, and a fourth of the receptacles is aligned with the access opening while the rotor is in a fourth rotational position. As best understood with reference to FIG. 4, while one of the spindle receptacles 32 is aligned with the access opening 18, 20, 22 for receiving a flexible tensile member therethrough, for one or more of, or each of, the other spindle receptacles, respective structure of housing 24, 26, 28, or respective portion(s) of the cover 26, 28, can restrict the flexible tensile member from being received in the other spindle receptacles.

Figure 20:
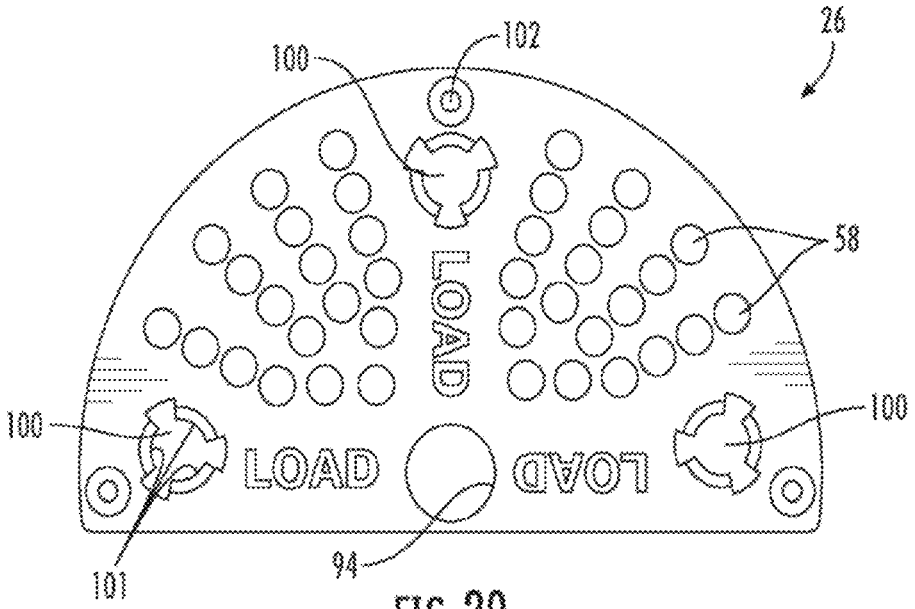
FIG. 20 is an isolated top plan view of a cover of a reel apparatus of a second embodiment of this disclosure.
Figure 21:
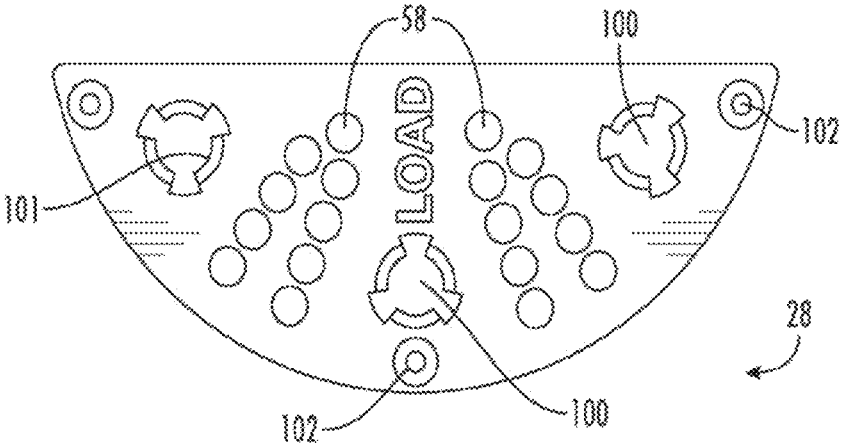
FIG. 21 is an isolated top plan view of another cover of the reel apparatus of the second embodiment.
Figure 22:
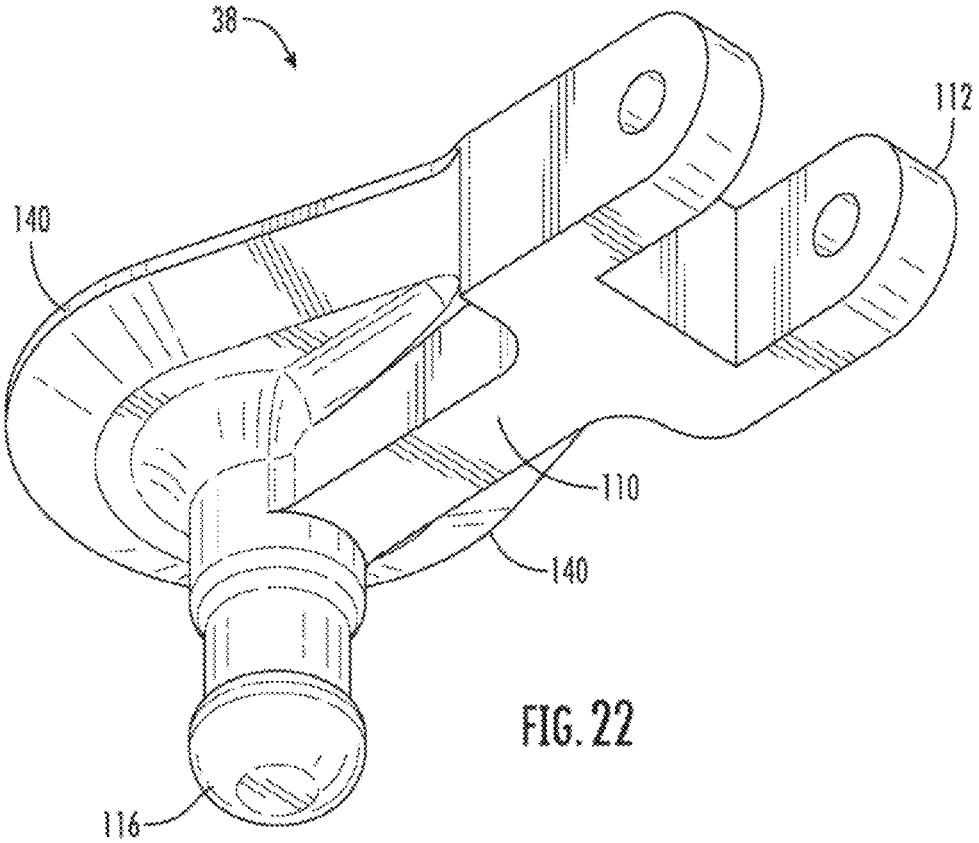
FIG. 22 is an isolated pictorial view of a crank of the reel apparatus of the second embodiment.
Figure 23:
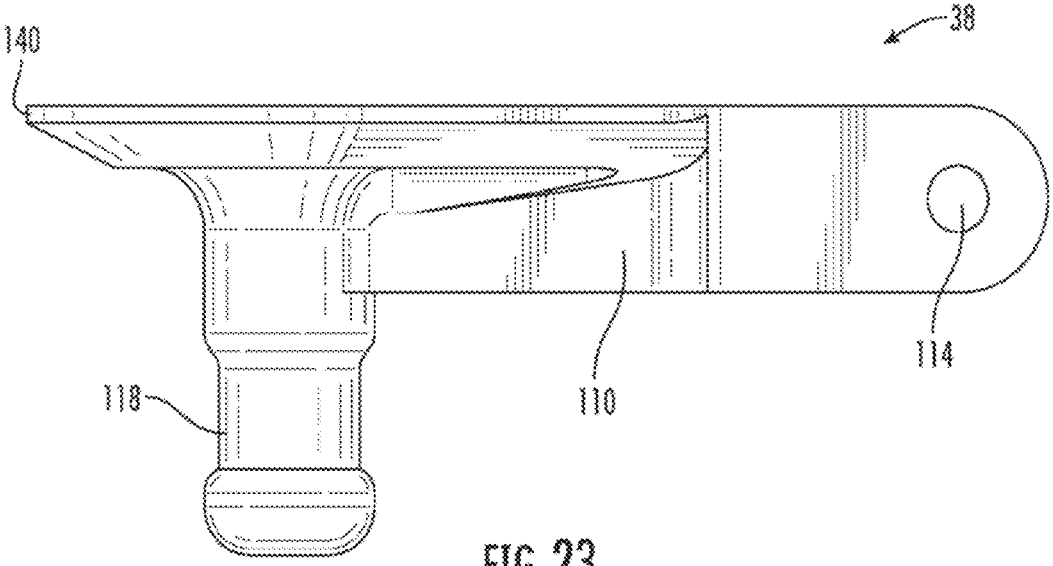
FIG. 23 can be referred to as a right elevation view of the crank of FIG. 22, wherein a left elevation view of the crank is a mirror image of FIG. 23.

A second embodiment of this disclosure can be like the first embodiment, except for variations noted and variations that will be apparent to one of ordinary skill in the art. Referring to FIGS. 20-21, the second embodiment cover parts 26, 28 can include a relatively lesser number of connector holes 100 that each can include a relatively greater number of inwardly extending catches 101 that extend accurately and define gaps therebetween. The second embodiment cover parts cover 26, 28 can include a relatively greater number of vent holes 58. Referring to FIGS. 22-23 the second embodiment crank 38 can include an arcuate flange 132 extending outwardly from, or that is part of, the crank shaft 110. The flange 132 can be manually grasped by a user when manually pivoting the crank 38 relative to the rotor 30, 34.

Figure 24:
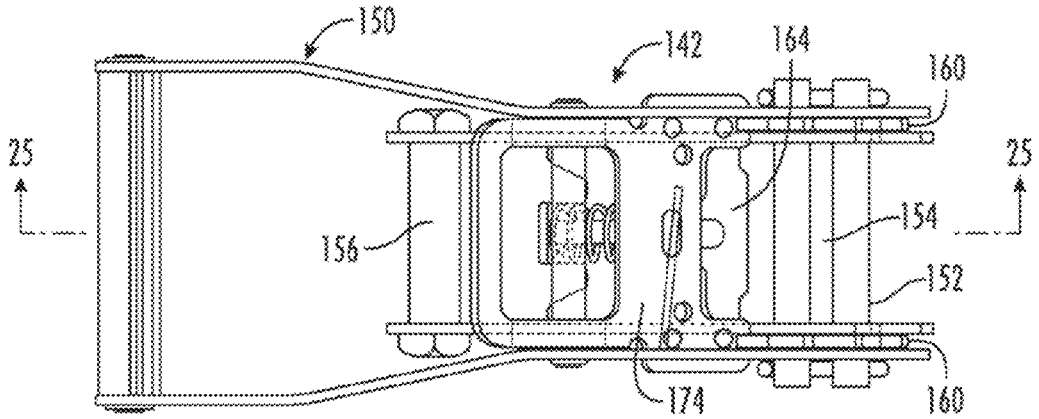
FIG. 24 PRIOR ART
FIG. 24 is a top plan view of a portion of a prior art ratchet strap system.
Figure 25:
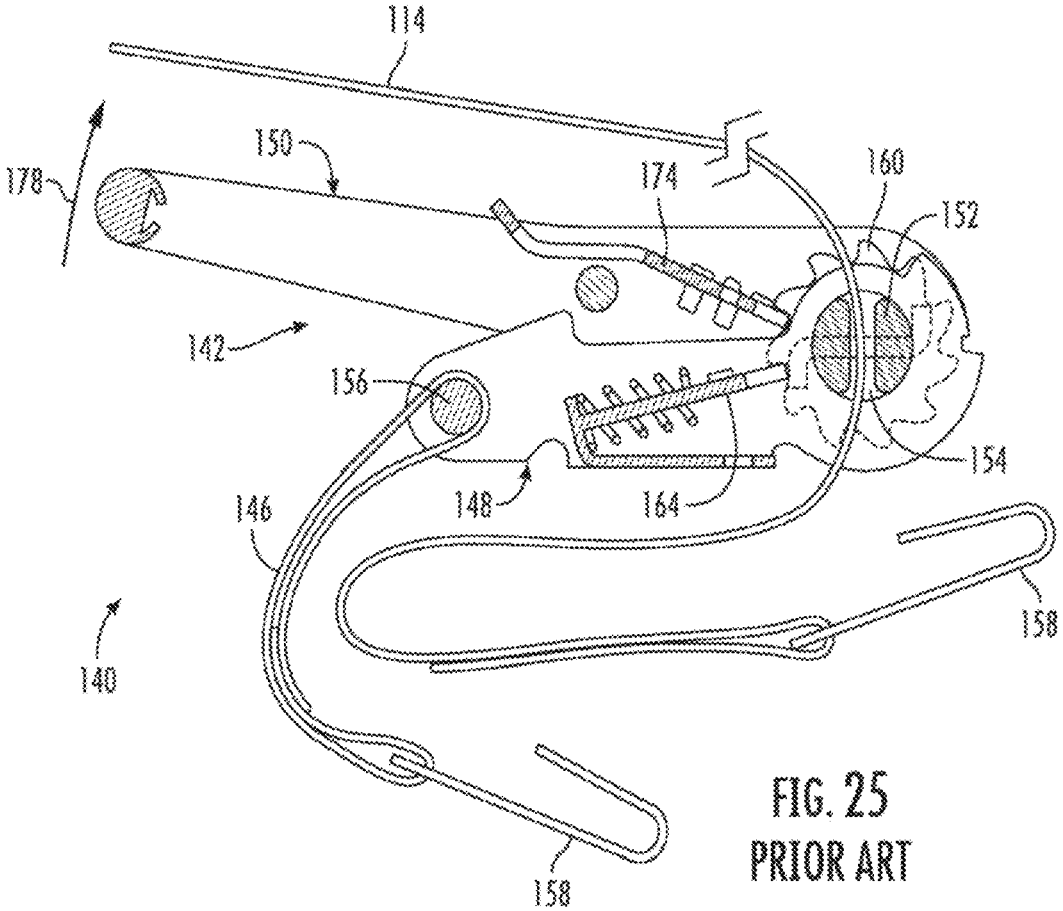
FIG. 25 PRIOR ART
FIG. 25 is a schematic side cross-sectional view of the ratchet strap system of FIG. 24 with its straps, wherein the cross section is taken along line 25-25 of FIG. 24.

As examples of methods of using the reel apparatus 10, it can be used with conventional tie down straps such as a conventional lashing strap apparatus including a crocodile clip, or the like; a conventional tied down strap in in the form of a conventional cam buckle strap apparatus; and/or a conventional tied down strap in the form of a conventional ratchet strap system. The skilled artisan will understand that some types of conventional tie down straps include a conventional length-adjusting and securing mechanism. The skilled artisan will understand the structures of, and how to use, such conventional tie down straps. That said, for ease of understanding FIGS. 24-25 depict an example of a conventional prior art ratchet strap system 140 that can be used with the reel apparatus 10. That said, the present invention is not limited to the following specific description of the ratchet strap system 140 since, for example, the reel apparatus 10 can be independent of, and used with a variety of different types of, tie down straps.

Referring to FIGS. 24-25, the conventional ratchet strap system 140 (FIG. 25) includes a ratchet apparatus 142 (e.g., length-adjusting and securing mechanism) associated with straps 144, 146. The ratchet apparatus 142 includes a base 148 and handle 146 that are pivotably connected to one another at a mandrel 152. The ratchet apparatus 142 is configured so that a user can manually cause repeated back and forth relative pivoting between the outer ends of the base and handle 148, 150, and so that in response to that pivoting the mandrel 152 rotates in a first direction relative to the ratchet apparatus. The strap 144 can be wound onto the mandrel 152 when it is rotated in the first direction. One or more ratchets can selectively allow rotation of the mandrel in an opposite second direction, as discussed further below.

The mandrel 152 is rotatably mounted between side members of the base 148. A slot 154 extends through the mandrel 152 and is configured to receive the strap 144. FIG. 25 depicts a medial portion of the strap 144 extending through the mandrel slot 154. For ease of understanding, the strap 144 may be referred to as "the adjustable strap" because its effective length is typically adjusted by winding the adjustable strap about, and unwinding the adjustable strap from, the mandrel 152, as discussed further below.

FIG. 25 depicts that the other strap 146 has opposite ends that in the form of end loops that are typically secured by stitches. A proximal end of the strap 146 is connected to the base 148 by way of a bolt 156 that extends through the proximal end loop of the strap 146. The bolt 156 is connected to and spans between the base side members. For ease of understanding, the strap 146 may be referred to as "the fixed strap" since its proximal end is connected to the base as indicated above. Distal ends of the straps 144, 146 can be connected to hooks 158 by way of respective end loops of the straps extending through eyelets of the hooks.

Ratchet wheels 160 are respectively fixedly connected to opposite end portions of the mandrel 152 for rotating with the mandrel The ratchet wheels 160 include outwardly protruding cams. A base pawl 164 is movably mounted to the base 148 and normally biased inwardly against the ratchet wheels 160 by at least one spring ("base spring") carried by the base 148. The cams are configured to push the base pawl 164 outwardly in a direction away from the ratchet wheels 160 in response to, and to allow, rotation of the mandrel 152 in the first direction (clockwise as depicted in FIG. 25). In contrast, the cams are configured to restrict rotation of the mandrel 152 in the opposite second direction (counterclockwise as depicted in FIG. 25) so long as the base spring forces the base pawl 164 inwardly into engagement with the ratchet wheel cams. The base pawl 164 is configured to be temporarily manually pulled outwardly in the direction away from the ratchet wheels 160 to allow rotation of the mandrel 152 in the second direction (counterclockwise as depicted in FIG. 25).

A handle pawl 174 is movably mounted to outer side members of the handle 150 and normally biased inwardly against the ratchet wheels 160 by at least one spring ("handle spring") carried by the handle. While the handle pawl 174 is forced into engagement with the ratchet wheels 160 by the handle spring and the handle is manually moved in an arcuate direction as schematically represented by arrow 178 (FIG. 25), the mandrel 152 rotates in the first direction (clockwise as depicted in FIG. 25), for example to wind the adjustable strap 144 onto the mandrel 152. While the handle 150 is rotated back in a direction opposite the direction of arrow 178, the cams push the handle pawl 174 outwardly in a direction away from the ratchet wheels 160. The handle pawl 174 is configured to be temporarily manually pulled outwardly in the direction away from the ratchet wheels 160 to allow rotation of the mandrel 152 in the second direction (counterclockwise as depicted in FIG. 25).

Figure 26:
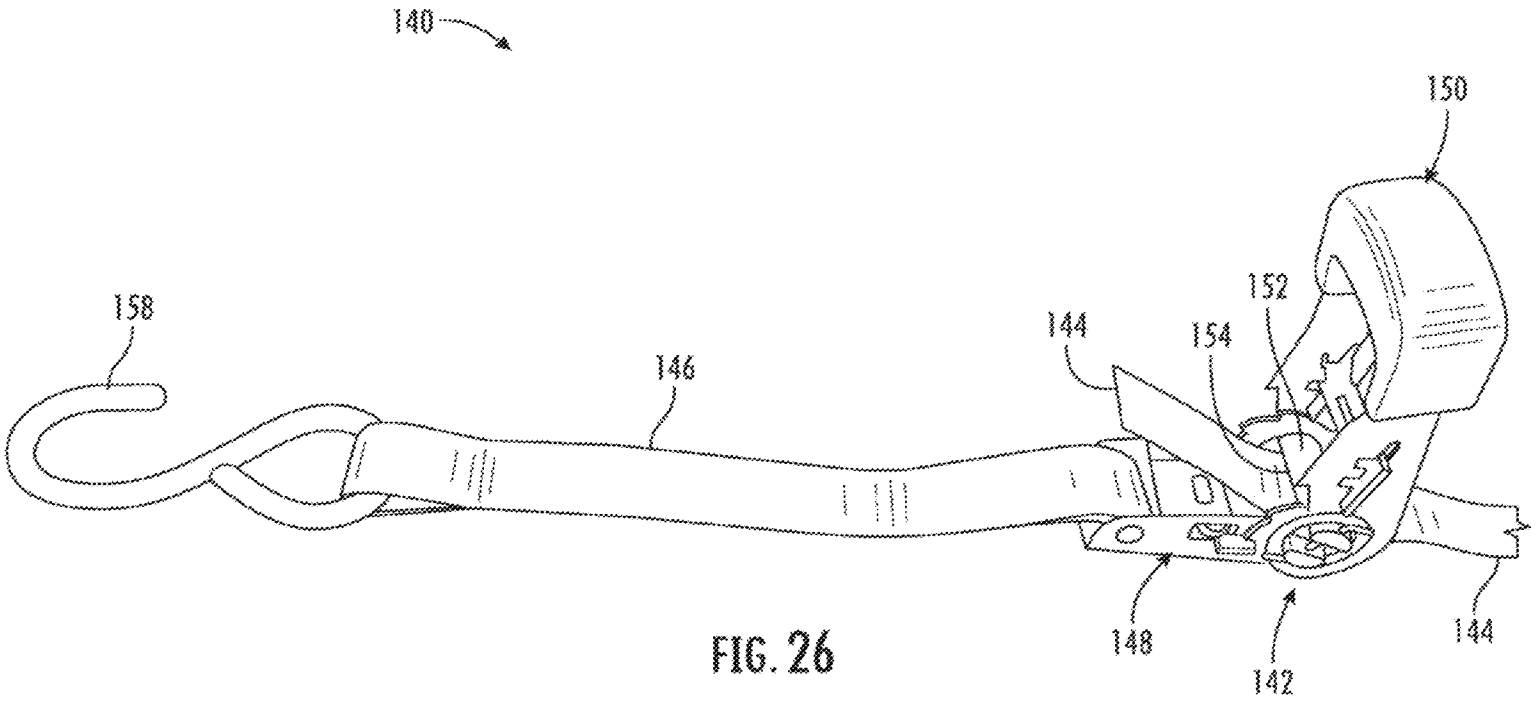
FIG. 26 depicts the ratchet strap system being configured for use with the reel apparatus, in accordance with an embodiment of this disclosure.
Figure 28:
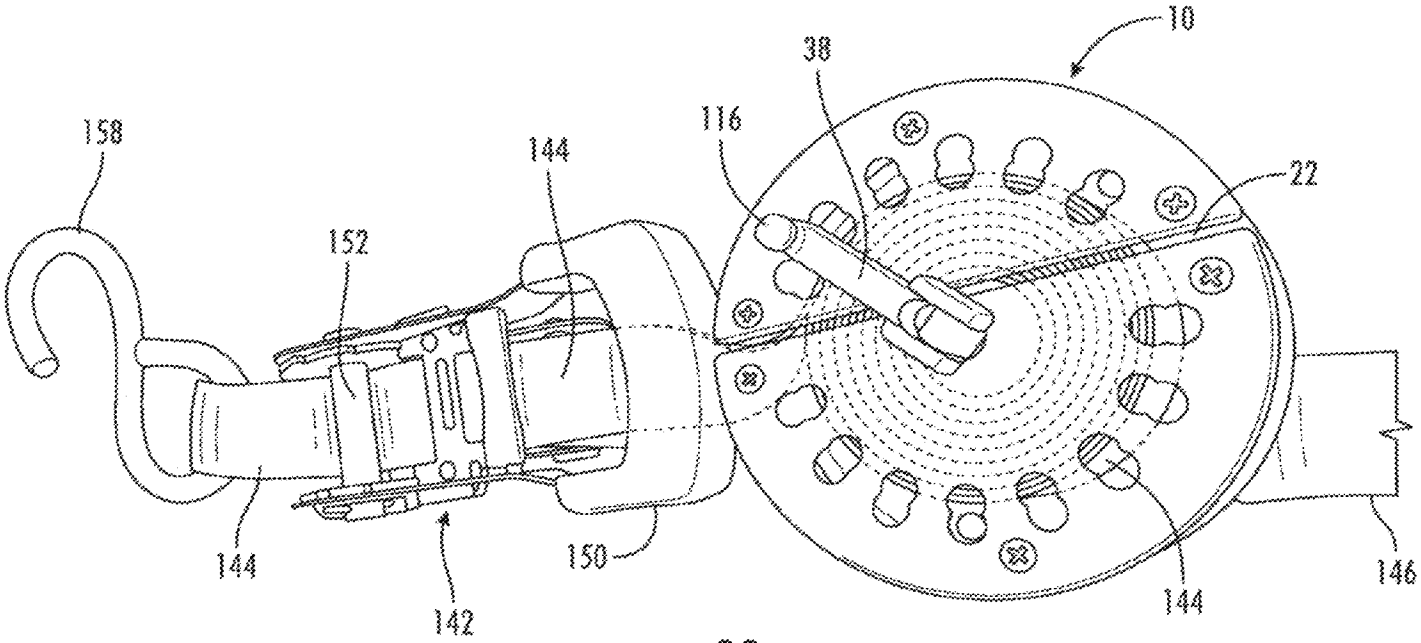
FIG. 28 depicts an example of the reel apparatus in combination with the ratchet strap system.

Non-limiting examples of methods of using the reel apparatus 10 with the conventional ratchet strap system 140 are described in the following. Initially, the adjustable strap 144 can be completely separated from the ratchet mandrel 152. Referring to FIG. 26, the ratchet apparatus base 148 can be arranged generally horizontally and the fixed strap 146 can extend generally horizontally and straight away from the base 148. Then, the ratchet apparatus handle 150 can be pivoted (e.g., pivoted back and forth) relative to the base 148 until the ratchet mandrel slot 154 extends generally horizontally and is relatively parallel with the base 148 and is relatively in line with the base 148 and the fixed strap 146. Then, the proximal end of the adjustable strap 144 can be inserted into the opening of the ratchet mandrel slot 154 that is facing away from the fixed strap 146, and the proximal end of the adjustable strap can be pushed through the ratchet mandrel slot to achieve the configuration depicted in FIG. 26. A portion of the adjustable strap 144 can then be pulled through the ratchet mandrel slot 154 so that the distal end of the adjustable strap 144 with its hook 152 becomes positioned proximate the ratchet mandrel 152 (e.g., as depicted in FIG. 28). For ease of understanding, the portion of the adjustable strap 144 extending between the ratchet mandrel 152 and the proximal end of the adjustable strap can be referred to as a proximal length of (e.g., a tail of or first length of) the adjustable strap, and the length of the adjustable strap extending between the ratchet mandrel and the distal end (e.g., hook end) of the adjustable strap can be referred to as a distal length of (e.g., a second length of) the adjustable strap.

Figure 27:
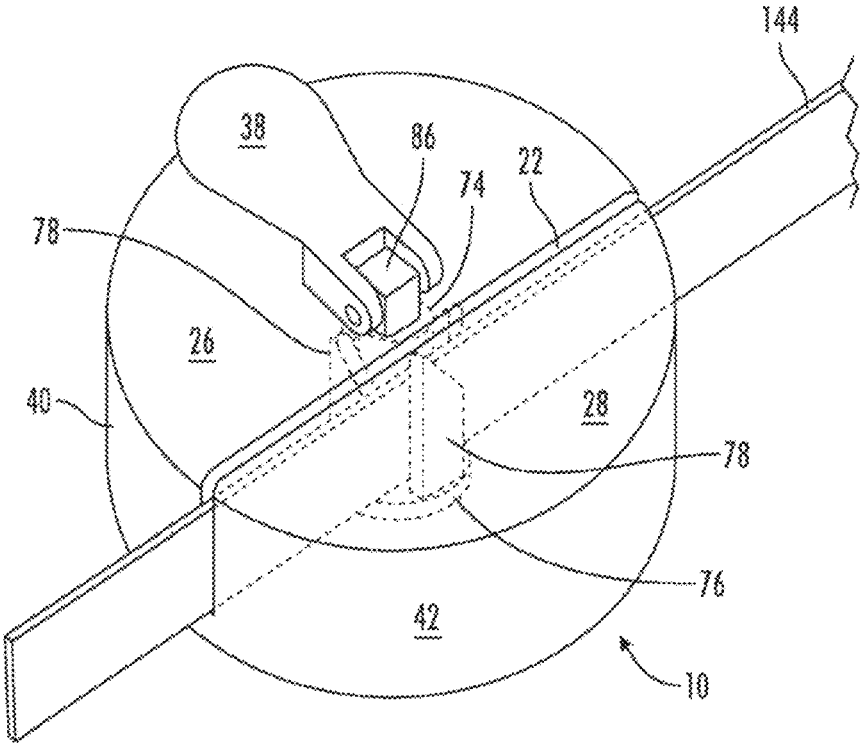
FIG. 27 is a schematic pictorial view that depicts a portion of a strap of the ratchet strap system inserted into the reel apparatus, in accordance with an embodiment of this disclosure.

After preparing the ratchet strap system 140 for use the reel apparatus 10 as described above, a user can arrange the proximal length of the adjustable strap 144 in an untwisted configuration by manually sliding fingers along the proximal length from proximate the mandril 142 to the proximal end portion of the proximal length. Referring to FIG. 27, with the proximal length of the adjustable strap 144 in an untwisted or substantially untwisted configuration, a portion of the proximal length near the proximal end of the adjustable strap 144 can be laterally inserted into and/or through the access openings 18, 20, 22 and, thus, be inserted into a respective receptacle 32 that is aligned with the access opening 18, 20, 22. In accordance with the first and second embodiments, the rotor 30, 34 and housing 24, 26, 28 are cooperatively configured so that, when the rotor is in a respective rotational position, a respective receptacle 32 is configured to receive a portion of the length of the adjustable strap 144 while the adjustable strap simultaneously extends through both of the access openings 18 and 20.

With a portion of the adjustable strap 144 mated into the reel apparatus 10 as depicted in FIG. 27 and the crank 38 in its open configuration (see, e.g., FIG. 28), the crank can be manually rotated to wind at least some of, or a majority of, the proximal length of the adjustable strap 144 onto the rotor 30, 34 to form a rolled portion of the adjustable strap in the interior space of the housing 24, 26, 28, for example as depicted in FIG. 28. Then the crank 38 can be placed in its closed or locking configuration, as discussed above, to secure the rolled portion of the adjustable strap 144 in the housing 24, 26, 28. With the crank 38 closed or locked, the rolled portion of the adjustable strap 144 in the housing 24, 26, 28 can remain in that configuration for storage purposes and/or for being transported to another location.

Figure 29:
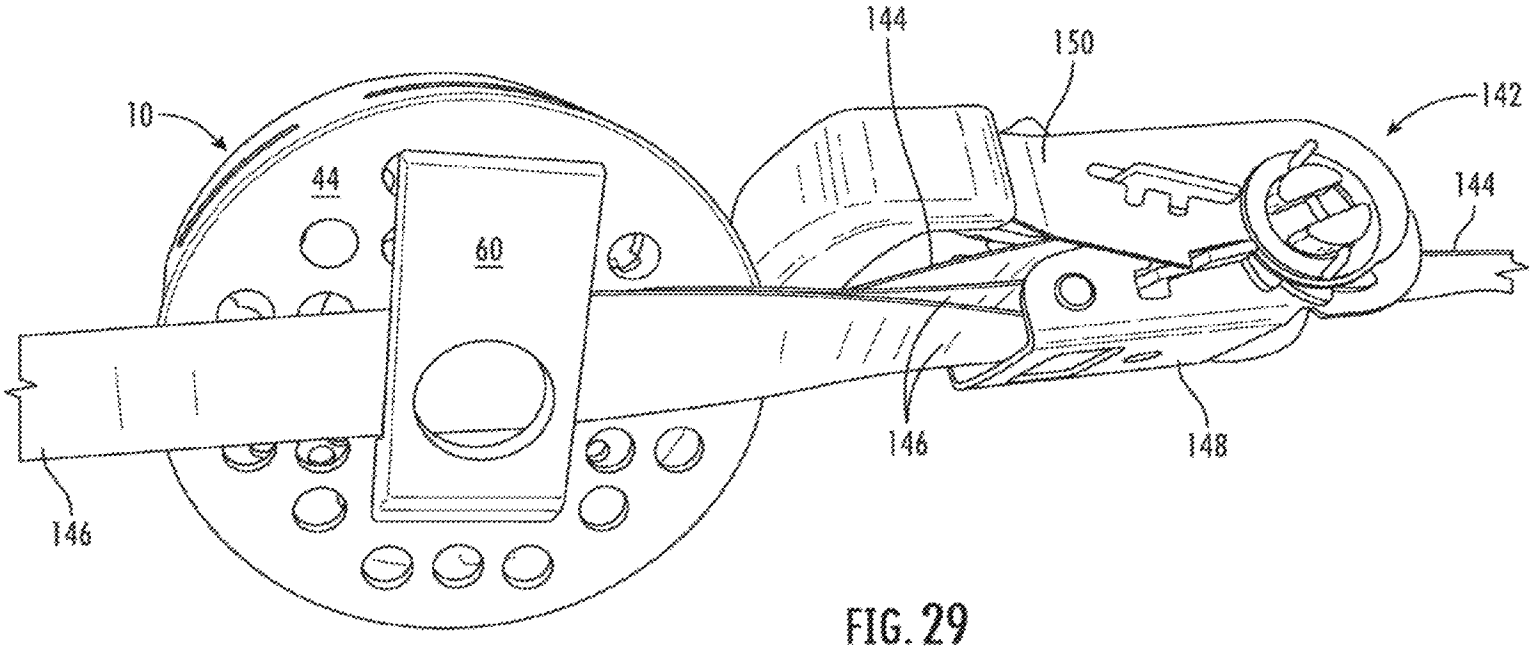
FIG. 29 depicts another example of the reel apparatus in combination with the ratchet strap system.
Figure 30:
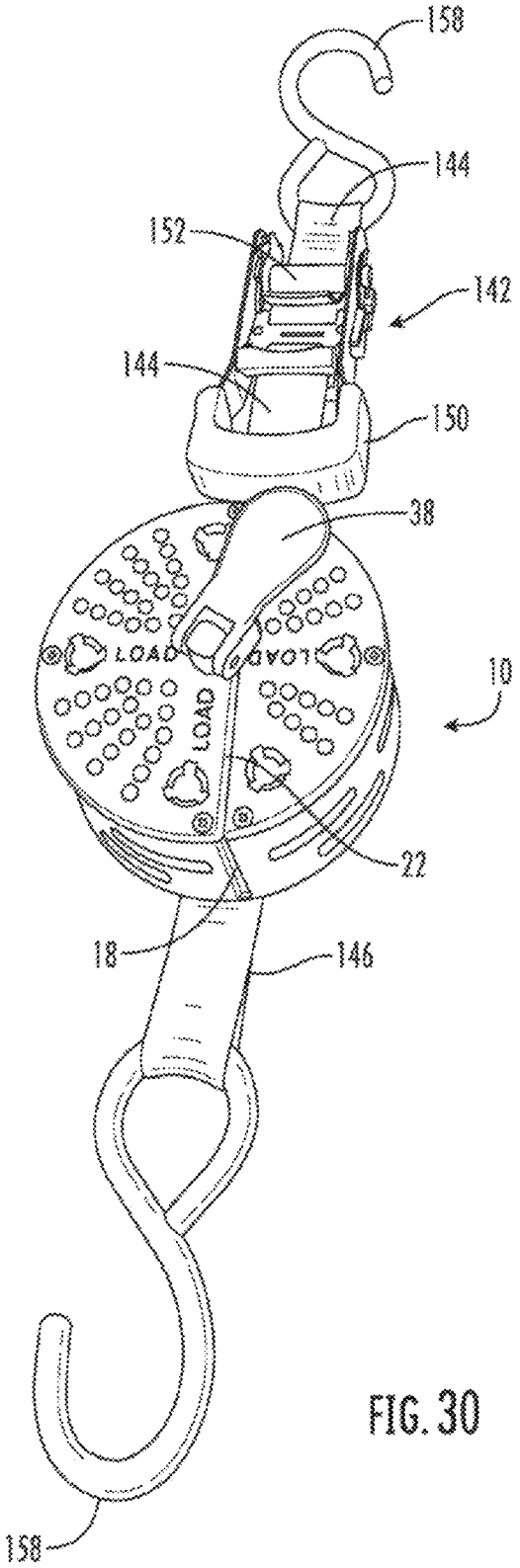
FIG. 30 depicts another example of the reel apparatus in combination with the ratchet strap system.

Referring to FIG. 29, while the crank 38 is in its closed or locked configuration and the rolled portion of the adjustable strap 144 is in the housing 24, 26, 28, or at any other suitable time, the reel apparatus 10 can optionally be connected to the fixed strap 146 using the connector 60 and/or other suitable connector(s), so that a medial portion of the fixed strap extends through and is secured in the passageway 68 (FIG. 8) that can be defined by, or at least partially defined by, the connector 60. FIGS. 29 and 30 depict the reel apparatus 10 and ratchet strap system 140 in an example of a mounted-together, compact and locked configuration in which, for example, the adjustable strap 144 extends through the ratchet mandrel slot 154, a rolled portion of the adjustable strap extends around the rotor 30, 34 in the housing 24, 26, 28, and the crank 38 is in its closed/locked configuration. In the mounted-together, compact and locked configuration, the reel apparatus 10 together with the ratchet strap system 140 is ready for storage, transportation, as well as easy access for use in securing one or more items, as discussed further below. By completing respective above-described steps in reverse, the reel apparatus 10 and ratchet strap system 140 can be separated from one another, and the adjustable strap 144 can be removed from the reel apparatus and the ratchet apparatus 142.

Optionally, the connector 60 may be omitted or the reel apparatus 10 may otherwise not be connected to the fixed strap 146. That said, in the following examples the reel apparatus 10 is maintained connected to the fixed strap 146 by the connector 60, even though the reel apparatus could be manually held, secured, or placed in any other suitable manner during use of the reel apparatus 10 together with the ratchet strap system 140.

Figure 31:
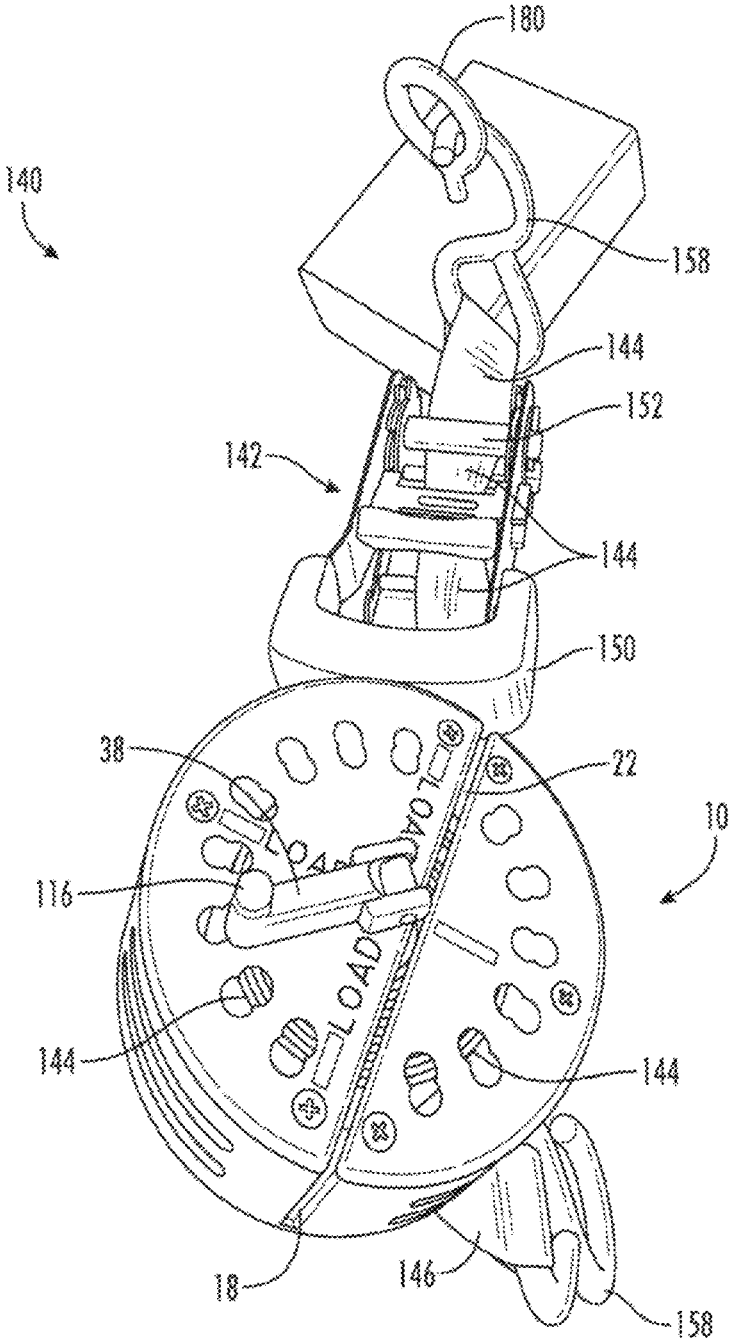
FIG. 31 depicts an example of the reel apparatus in combination with the ratchet strap system and an attachment point.
Figure 33:
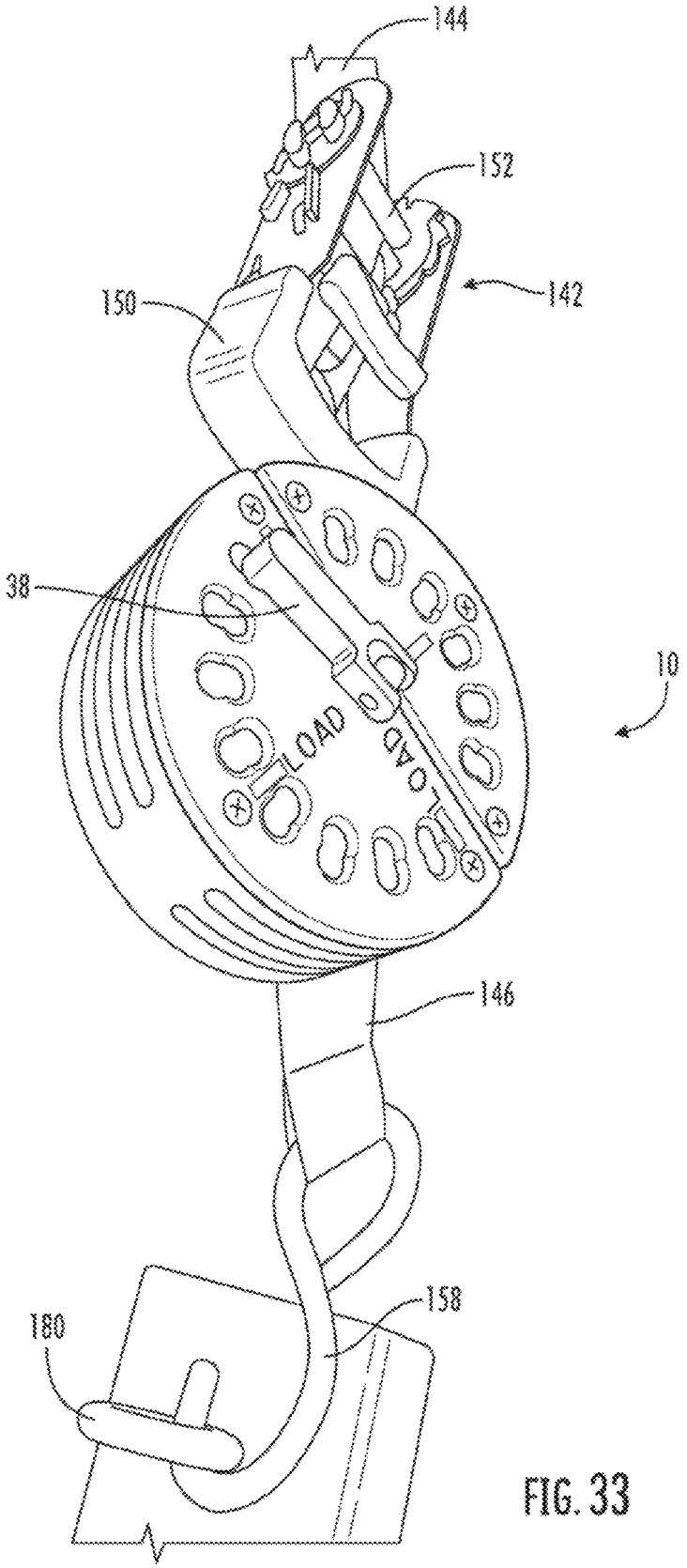
FIG. 33 depicts an example of the reel apparatus in combination with the ratchet strap system and another attachment point.

Referring to FIGS. 29-30, while the reel apparatus 10 and ratchet strap system 140 are in their mounted-together, compact and locked configuration, the crank 38 can be manually moved to its open or unlocked configuration so that the reel apparatus 10 and ratchet strap system 140 are in their mounted-together, compact and unlocked configuration. FIG. 31 depicts the reel apparatus 10 and ratchet strap system 140 in their mounted-together, compact and unlocked configuration, since the crank 38 is in its open or unlocked configuration. Also in the example depicted in FIG. 31, the distal end of the adjustable strap 144 is connected by way of its hook 158 to structure, for example one of a pair of attachment points 180 (e.g., fittings and/or other suitable structure). For the present example, FIG. 33 depicts the other of the attachment points 180. The attachment points typically are sturdy structures that are fixed relative to one another. FIG. 34 depicts an example of at least one item 182 (e.g., cargo item) being secured between the attachment points 180.

Figure 32:
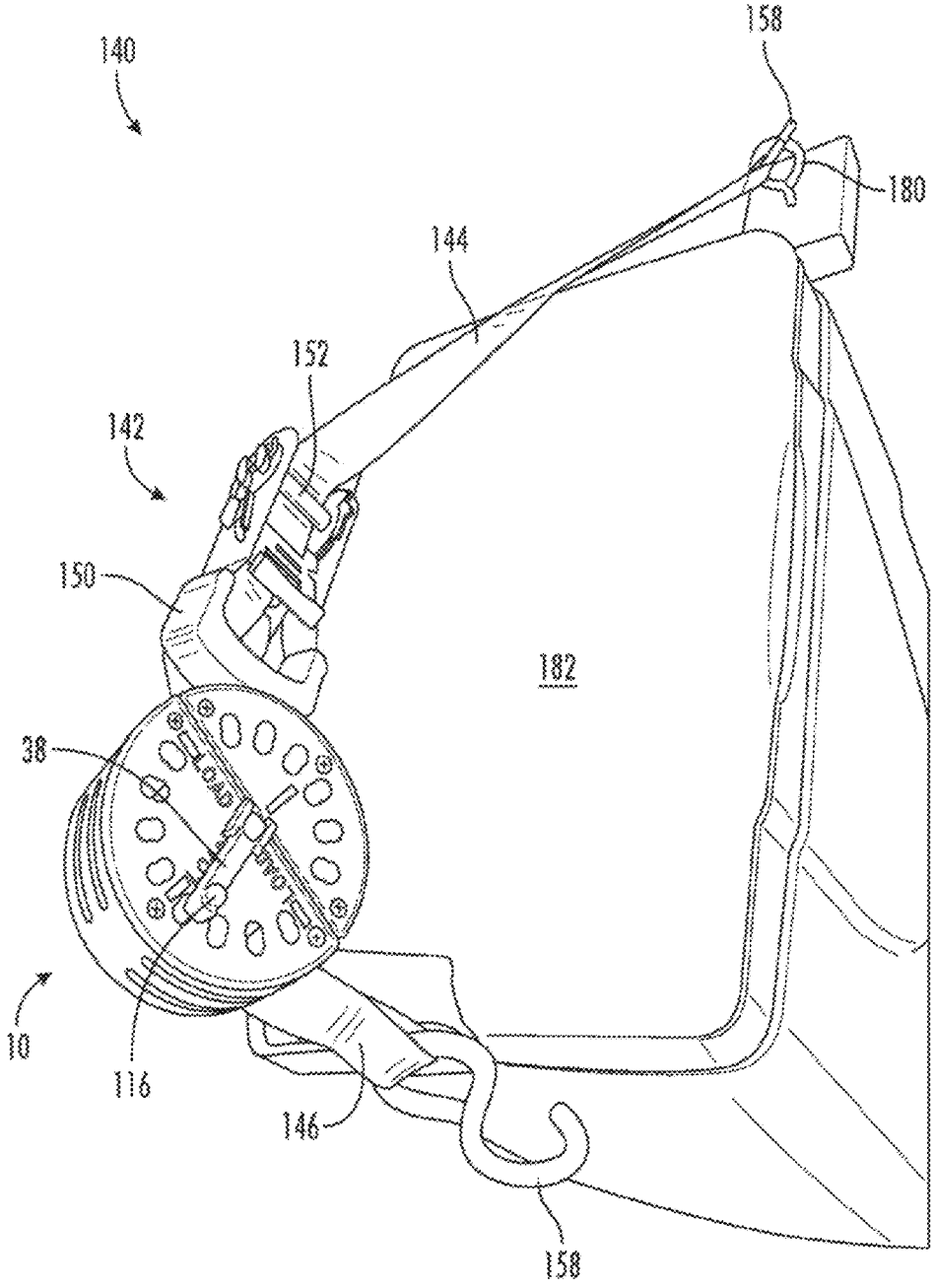
FIG. 32 depicts an example of the reel apparatus in combination with the ratchet strap system, attachment point, and a cargo item.

In the example depicted in FIG. 31, the access openings 18, 20, 22 collectively extend crosswise to (e.g., perpendicular to) the ratchet mandrel slot 154 and the axis of rotation of the ratchet mandrel 152. While the reel apparatus 10 and ratchet strap system 140 are in their mounted-together, compact and unlocked configuration with the adjustable strap 144 connected to the respective attachment point 180 as depicted in FIG. 31, the reel apparatus 10 together with the ratchet apparatus 142 can be moved away from the distal end of the adjustable strap and at least partially over or around the cargo item 182 (FIG. 32). In response to this movement of the reel apparatus 10 together with the ratchet apparatus 142 away from the respective structure (e.g., attachment point 180 to which the distal end of the adjustable strap 144 is connected), at least some of the adjustable strap 144 is unwound from the roll in the housing 24, 26, 28 and pulled outwardly through the opening, hole, or slot 20 (see, e.g., FIG. 6). Then and as best understood with reference to FIG. 33, the distal end of the fixed strap 146 can be connected by way of its hook 158 to the respective structure, for example the other of the attachment points 180. Then, the crank 38 can be placed in its closed or locked configuration while there is enough slack in the adjustable strap 144 to facilitate secured tensioning of the adjustable strap by operating the ratchet apparatus 142. Then, ratchet apparatus 142 can be operated so that a portion of the adjustable strap becomes wound around the ratchet mandrel 152 and the proximal length of the adjustable strap 144 is tightened (becomes tensioned) by way of at least one or preferably about two or more rotations of the ratchet mandrel to provide a tightened and secured configuration of the overall system.

While the overall system is in its tightened and secured configuration, any undesirable slack in the proximal length of the adjustable strap 144 can be removed by operating the reel apparatus to draw some of the proximal length of the adjustable strap into the housing 24, 26, 28 and add it to the rolled portion of the adjustable strap in the housing 24, 26, 28.

Releasing the overall system from its tightened and secured configuration can begin with manipulating the ratchet apparatus 142 in a conventional manner to release the one or more ratchets thereof and allow rotation of the ratchet mandrel 152 in opposite directions. For example, the pawls 164, 174 can be manually disengaged from (moved away from) the ratchet wheels 160. In some ratchet apparatus 142, the ratchet apparatus is configured to maintain the pawls 164, 174 in their disengaged configuration relative to the ratchet wheels 160 when the ratchet handle 150 is in an open position that is reached by pivoting the handle 150 away from the base 148 so that a maximum angle (e.g., of about 180 degrees) is defined between the handle and the base. With the one or more ratches of the ratchet apparatus 142 released, the portion of the adjustable strap 144 wound around the ratchet mandrel 152 can be unwound by causing relative movement between one or more respective portions of the adjustable strap and the ratchet apparatus. For example, the adjustable strap 144 can be firmly manually griped on each side of the ratchet apparatus 142 by a user, and the user can move the gripped portions of the adjustable strap in opposite directions until the adjustable strap is fully unwound from the ratchet mandrel 152 and the ratchet mandrel slot 154 is about parallel with the ratchet base 148 and generally in line with the portion of the adjustable strap extending through the ratchet mandrel slot. The ratchet handle 150 can be moved to its closed position by pivoting it toward the ratchet base 148. The distal ends of the straps 144, 146 can be disconnected from the attachment points 180, and the mounted-together, compact and locked configuration can be achieved by repeating respective steps described above.

In a variation of the above-described method, the distal ends of the straps 144, 146 can be directly attached (e.g., via respective hooks 158) to the same attachment point 180. In other variations of the above-described method, the distal end of the adjustable strap 144 and/or the distal end of the fixed strap 146 can be connected to the respective attachment point(s) 180 prior to the respective above-described steps (e.g., prior to the proximal end of the adjustable strap 144 being inserted through the ratchet mandrel slot 154, the respective portion of the adjustable strap being wound into the reel apparatus 10, and the reel apparatus together with the ratchet strap system 140 being used as described above to secure the cargo item 182).

In accordance with an aspect of this disclosure, while the reel apparatus 10 is operatively associated with the ratchet strap system 140, the ratchet mandrel slot 154 can be set and kept in a position parallel to the ratchet base 148 so the adjustable strap 144 is able to pass freely back and forth through the ratchet mandrel slot substantially without resistance. This allows for the quick deployment of the adjustable strap 144.

According to an aspect of this disclosure, while the reel apparatus 10 is operatively associated with the ratchet strap system 140, the tail (e.g., hookless end) of the adjustable strap 144 can be controlled and/or contained for ratchet strap system storage and use.

In an aspect of this disclosure, the housing 24, 26, 28 or other suitable device, caddy, container, or the like, can be secured (e.g., releasably secured) to the fixed strap 146 and/or the adjustable strap 144 of the ratchet strap system for the purpose of securing and controlling the adjustable strap.

At least partially reiterating from above, one or more of the two covers 26, 28 (FIGS. 1, 16 and 17) can be omitted, configured differently, or the like. For example, in an alternative embodiment of the reel apparatus 10, the two covers 26, 28 can be replaced with a single removable cover or lid (not shown). It is believed the lid can omit each of the transverse slot 22 (FIGS. 1 and 2) and mounting holes 102 (FIGS. 16-17). It is believed the lid can include one or more of the connector holes 100, or the like. For removably mounting the lid to the container 24 (FIGS. 5-7) to close (e.g., obstruct) the main opening to the container interior space 14 (FIGS. 5-7), it is believed the lid can include an internally threaded annular flange configured to threadedly engage external screw thread(s) of the one or more sidewalls 40, 42 (FIGS. 6 and 7), or the like, and/or the lid can be mounted in any other suitable manner (e.g., by way of clips, clip-like features, interference fits, or the like, that allow the lid to be removably snap fit onto and/or into the container 24, or the like). It is believed the lid can include the bearing hole 94 (FIG. 16), a modification thereof, and/or other suitable features cooperatively configured with a crank-driven rotor so that the rotor is rotatably mounted to the lid. In one example, it is believed that free ends of the rotor's prongs 78 (FIG. 12) can be adjacent to the container's lower base panel 44 (FIGS. 5, 7 and 9) when the lid is mounted to the container 24. Differently configured rotors and other features are within the scope of this disclosure.

To supplement the present disclosure, this application incorporates by reference the entire disclosure, including the Appendix of, of U.S. Provisional Patent Application No. 63/300,429, filed Jan. 18, 2022. Also to supplement the present disclosure, the structure and functionality of the length-adjusting and securing mechanism and associated flexible tensile members (e.g., straps) disclosed by U.S. Pat. No. 5,623,750 is incorporated herein by reference.

Reiterating from above, it is within the scope of this disclosure for one or more of the terms "substantially," "about," "approximately," and/or the like, to qualify each of the adjectives and adverbs of the foregoing disclosure for the purpose of providing a broad disclosure. As an example, it is believed that those of ordinary skill in the art will readily understand that, in different implementations of the features of this disclosure, reasonably different engineering tolerances, precision, and/or accuracy may be applicable and suitable for obtaining the desired result. Accordingly, it is believed that those of ordinary skill will readily understand usage herein of the terms such as "substantially," "about," "approximately," and the like.

In the specification and drawings, examples of embodiments have been disclosed. The present invention is not limited to such exemplary embodiments. The use of the term "and/or" includes any and all combinations of one or more of the associated listed items. Unless otherwise noted, specific terms have been used in a generic and descriptive sense and not for purposes of limitation

The invention claimed is:

1. A reel apparatus configured to wind, store, and dispense a strap of a ratchet strap system, the reel apparatus comprising:

a housing comprising a base, a cover, and at least one sidewall extending at least partially around an interior space of the housing that is positioned between the base and the cover, wherein the at least one sidewall comprises first and second openings to the interior space;

a rotor at least partially positioned in the interior space and mounted to the housing for rotating about a rotational axis of the rotor, wherein:

the rotor comprises a receptacle cooperatively configured with the housing to receive a portion of a length of a strap that simultaneously extends through the first and second openings, the at least one sidewall extends at least partially around the axis of the rotor, the first and second openings are spaced apart from one another around the rotational axis of the rotor, the cover comprises first and second cover parts, a gap defined between the first and second cover parts is a third opening to the interior space, the third opening extends crosswise to and is laterally offset from the rotational axis of the rotor, and the third opening extends to and is open to each of the first and second openings, and the rotor and the housing are cooperatively configured so that:

the strap can be pulled into the interior space through the first opening in response to the strap being wound onto the rotor, and the strap can be unwound from the rotor in response to the strap being pulled outwardly from the interior space through the first opening.

2. The reel apparatus according to claim 1, comprising a connector connected to the base of the housing, wherein the connector is configured to be connected to a second strap of a ratchet strap system.

3. The reel apparatus according to claim 1, wherein:
the receptacle of the rotor is a first receptacle;
the rotor comprises a second receptacle configured to receive a portion of a length of the strap that simultaneously extends through the first and second openings; and
the first and second receptacles are spaced apart from one another around the rotational axis of the rotor.

4. The reel apparatus according to claim 3, wherein the rotor comprises:
a shaft extending substantially coaxially with the rotational axis of the rotor;
a base connected to the shaft; and
a plurality of projections connected to the base and extending along the rotational axis of the rotor,
wherein the first and second receptacles comprise gaps respectively defined between the shaft and respective projections of the plurality of projections.

5. The reel apparatus according to claim 4, wherein:
the shaft is a tube;
the rotor comprises an axle extending at least partially through the tube;
the axle is rotatably mounted to the housing; and
a crank is pivotably connected to the axle.

6. The reel apparatus of claim 5 in combination with a ratchet strap system, wherein:
the strap is a strap of the ratchet strap system;
a portion of the strap is wound upon the rotor; and
a portion of the strap extends through a mandrel slot of the ratchet strap system.

7. The combination according to claim 6, wherein:
the strap is a first strap;
the ratchet strap system comprises a second strap; and
the reel apparatus comprises a connector connected to the second strap so that a portion of the second strap extends through a passageway at least partially defined by the connector.

8. The reel apparatus according to claim 1, comprising a crank connected to the rotor for rotating with the rotor, wherein at least a portion of the crank is positioned outside of the interior space and configured to be manually engaged for rotating the crank together with the rotor about the rotational axis of the rotor.

9. The reel apparatus of claim 1 in combination with a ratchet strap system, wherein:
the strap is a strap of the ratchet strap system;
a portion of the strap is wound upon the rotor; and
a portion of the strap extends through a mandrel slot of the ratchet strap system.

10. The combination according to claim 9, wherein:
the strap is a first strap;
the ratchet strap system comprises a second strap; and
the reel apparatus comprises a connector connected to the second strap so that a portion of the second strap extends through a passageway at least partially defined by the connector.

11. A reel apparatus configured to wind, store, and dispense a strap of a ratchet strap system, the reel apparatus comprising:
a housing comprising a base, a cover, and at least one sidewall extending at least partially around an interior space of the housing that is positioned between the base and the cover, wherein the at least one sidewall comprises first and second openings to the interior space;
a rotor at least partially positioned in the interior space and mounted to the housing for rotating about a rotational axis of the rotor, wherein the rotor comprises a receptacle cooperatively configured with the housing to receive a portion of a length of a strap that simultaneously extends through the first and second openings, the at least one sidewall extends at least partially around the axis of the rotor, the first and second openings are spaced apart from one another around the rotational axis of the rotor, and the rotor and the housing are cooperatively configured so that:
the strap can be pulled into the interior space through the first opening in response to the strap being wound onto the rotor, and
the strap can be unwound from the rotor in response to the strap being pulled outwardly from the interior space through the first opening;
a crank connected to the rotor for rotating with the rotor, wherein at least a portion of the crank is positioned outside of the interior space and configured to be manually engaged for rotating the crank together with the rotor about the rotational axis of the rotor; and
at least one fastening mechanism for releasably securing the crank in a plurality of rotational positions about the rotational axis of the rotor, wherein the rotor, the crank, and the at least one fastening mechanism are cooperatively configured to:
releasably secure the crank to the housing in a first fastened configuration to releasably secure the rotor in a first rotational position of the plurality of rotational positions, and
releasably secure the crank to the housing in a second fastened configuration to releasably secure the rotor in a second rotational position of the plurality of rotational positions.

12. The reel apparatus according to claim 11, wherein:
the at least one fastening mechanism comprises:
first and second fastener parts spaced apart from one another around the rotational axis of the rotor, and
a third fastener part connected to the crank for rotating with the crank about the rotational axis of the rotor relative to the first and second fastener parts;
the first and third fastener parts are configured to be engaged with one another in the first fastened configuration; and
the second and third fastener parts are configured to be engaged with one another in the second fastened configuration.

13. The reel apparatus according to claim 12, wherein:
the crank is pivotably connected to the rotor for being pivoted about an axis extending crosswise to the rotational axis of the rotor; and
the third fastener part is connected to the crank for pivoting with the crank into and out of engagement with the first and second fastener parts, respectively.

14. The reel apparatus according to claim 13, wherein:
the first and second fastener parts respectively comprise first and second holes in the cover; and
the third fastener part comprises a handle connected to the crank for moving with the crank and configured to:
extend into the first hole of the cover in the first fastened configuration, and
extend into the second hole of the cover in the second fastened configuration.

15. The reel apparatus of claim 14 in combination with a ratchet strap system, wherein:

the strap is a strap of the ratchet strap system;

a portion of the strap is wound upon the rotor; and a portion of the strap extends through a mandrel slot of the ratchet strap system.

16. The combination according to claim 15, wherein:

the strap is a first strap;

the ratchet strap system comprises a second strap; and the reel apparatus comprises a connector connected to the second strap so that a portion of the second strap extends through a passageway at least partially defined by the connector.

17. The reel apparatus of claim 12 in combination with a ratchet strap system, wherein:

the strap is a strap of the ratchet strap system;

a portion of the strap is wound upon the rotor; and a portion of the strap extends through a mandrel slot of the ratchet strap system.

18. The combination according to claim 17, wherein:

the strap is a first strap;

the ratchet strap system comprises a second strap; and the reel apparatus comprises a connector connected to the second strap so that a portion of the second strap extends through a passageway at least partially defined by the connector.

19. The reel apparatus of claim 11 in combination with a ratchet strap system, wherein:

the strap is a strap of the ratchet strap system;

a portion of the strap is wound upon the rotor; and a portion of the strap extends through a mandrel slot of the ratchet strap system.

20. The combination according to claim 19, wherein:

the strap is a first strap;

the ratchet strap system comprises a second strap; and the reel apparatus comprises a connector connected to the second strap so that a portion of the second strap extends through a passageway at least partially defined by the connector.

* * * * *